US008215073B2

(12) United States Patent
Gorman et al.

(10) Patent No.: US 8,215,073 B2
(45) Date of Patent: Jul. 10, 2012

(54) WEATHER PROTECTION SYSTEM

(75) Inventors: Robert Gorman, Boca Raton, FL (US); Yehuda Ozari, Belmont, NC (US); Aaron Belmont, Belmont, NC (US)

(73) Assignee: Hurricane Fabric, LLC, St. Louis, MO (US)

( * ) Notice: Subject to any disclaimer, the term of this patent is extended or adjusted under 35 U.S.C. 154(b) by 80 days.

(21) Appl. No.: 12/287,989

(22) Filed: Oct. 15, 2008

(65) Prior Publication Data

US 2009/0145048 A1 Jun. 11, 2009

Related U.S. Application Data

(60) Provisional application No. 60/999,031, filed on Oct. 15, 2007.

(51) Int. Cl.
*E04C 5/00* (2006.01)
*E06B 9/00* (2006.01)

(52) U.S. Cl. ..... 52/202; 52/4; 52/745.06; 52/713; 52/222; 160/368.1

(58) Field of Classification Search ..... 52/3, 4, 52/202, 5, 713, 222, 63, 745.06; 160/38, 160/327, 368.1; 135/119; 248/316.7, 200, 248/205.1, 207, 237, 218.4
See application file for complete search history.

(56) References Cited

U.S. PATENT DOCUMENTS 84,453 A * 11/1868 Whitney ..... 52/4
3,464,480 A * 9/1969 Kuss ..... 160/368.1
3,715,843 A 2/1973 Ballinger
5,228,408 A * 7/1993 Jannausch ..... 114/361
5,237,788 A 8/1993 Sandow
5,275,578 A 1/1994 Adams
5,292,328 A 3/1994 Hain et al.
5,318,261 A * 6/1994 Petershofer et al. ..... 248/205.1
5,497,537 A * 3/1996 Robinson et al. ..... 24/716
5,579,794 A 12/1996 Sporta
5,613,543 A * 3/1997 Walton ..... 160/265
5,791,090 A 8/1998 Gitlin et al.
5,800,006 A 9/1998 Pettigrew
5,860,251 A * 1/1999 Gleich ..... 52/2.25
5,974,740 A * 11/1999 Park ..... 52/3
6,010,176 A * 1/2000 Jones ..... 296/100.16
6,037,280 A 3/2000 Edwards et al.
6,070,629 A 6/2000 Whiteside (Continued)

OTHER PUBLICATIONS

International Search Report and Written Opinion of the International Searching Authority dated Dec. 31, 2008, International Application No. PCT/US 08/11749, 12 pages.

(Continued)

*Primary Examiner* — Robert Canfield
*Assistant Examiner* — Brent W Herring
(74) *Attorney, Agent, or Firm* — Brian B. Diekhoff; Polsinelli Shughart PC

(57) ABSTRACT

Weather protection systems, for use in protecting structures and structural elements during severe weather events, are disclosed. Also disclosed are methods of assembling and installing weather protection systems. Weather protection systems of this invention provide fabric to cover a structural element; the fabric is connected to the structure via a clip. A clip of is invention may include features such as fastening points, anchor points, and engaging members; a clip may also introduce a desirable point of flexibility into a system of the invention. Other features of weather protection systems of this invention may include resin and straps.

17 Claims, 14 Drawing Sheets

U.S. PATENT DOCUMENTS

| | | | | |
|---|---|---|---|---|
| 6,110,996 | A | 8/2000 | Ginsberg | |
| 6,176,050 | B1 | 1/2001 | Gower | |
| 6,230,455 | B1 * | 5/2001 | Arehart et al. | 52/202 |
| 6,273,113 | B1 * | 8/2001 | Streyckmans | 135/88.13 |
| 6,286,579 | B1 * | 9/2001 | Gottschalk | 160/264 |
| 6,325,085 | B1 | 12/2001 | Gower | |
| 6,338,428 | B1 | 1/2002 | Kawasaki et al. | |
| 6,412,540 | B2 | 7/2002 | Hendee | |
| 6,453,621 | B1 * | 9/2002 | Bundy et al. | 52/3 |
| 6,588,361 | B2 | 7/2003 | Biedenweg | |
| 6,865,852 | B2 | 3/2005 | Gower | |
| 6,886,299 | B2 | 5/2005 | Gower | |
| 6,994,891 | B2 * | 2/2006 | Ginsberg | 427/421.1 |
| 7,100,625 | B2 | 9/2006 | Valles | |
| 7,109,135 | B2 | 9/2006 | Taghavi | |
| 7,191,990 | B2 * | 3/2007 | Hutter, III | 248/229.12 |
| 7,325,365 | B2 * | 2/2008 | Warner | 52/203 |
| 7,461,485 | B2 * | 12/2008 | Toledo | 52/222 |
| 7,478,862 | B2 * | 1/2009 | Wiegel et al. | 296/98 |
| 7,610,727 | B2 * | 11/2009 | Toledo | 52/222 |
| 7,654,045 | B2 * | 2/2010 | Wiegel | 52/202 |
| 7,726,081 | B1 * | 6/2010 | Bennardo et al. | 52/222 |
| 7,997,036 | B1 * | 8/2011 | Motosko et al. | 52/202 |
| 2007/0107327 | A1 | 5/2007 | Warner | |
| 2007/0193137 | A1 * | 8/2007 | DeBoth | 52/202 |
| 2007/0204533 | A1 * | 9/2007 | Gower | 52/202 |
| 2007/0262219 | A1 * | 11/2007 | Hutter, III | 248/229.1 |
| 2008/0034671 | A1 * | 2/2008 | Harrington | 52/2.26 |
| 2008/0313979 | A1 * | 12/2008 | Holland et al. | 52/202 |
| 2008/0313980 | A1 * | 12/2008 | Holland et al. | 52/202 |

OTHER PUBLICATIONS

International Search Report and Written Opinion of the International Searching Authority dated Dec. 31, 2008, International Application No. PCT/US 08/11762, 10 pages.

Miami-Dade County, Notice of Acceptance issued to Armor Screen Corporation for "Armor Screen Series 2000" Flexible Wind Abatement System dated Nov. 13, 2008, with attachments dated Dec. 2, 2003. from www.miamidade.gov.

Miami-Dade County, Notice of Acceptance issued to Donovan Advanced Hurricane Protection, Inc. for Hurricane Protection System Flexible Wind Abatement System dated Jan. 3, 2008, with attachments dated Nov. 27, 2007. from www.miamidade.gov.

Department of Defense, MIL-PRF-20696F, issued Sep. 2, 1997 and entitled Performance Specification Cloth, Waterproof, Weather Resistant. from www.everyspec.com.

U.S. Government Printing Office, Fed. Test Method Std. No. 191A, issued Jul. 20, 1978, entitled Federal Standard for Textile Test Methods; pp. 337-382. from www.everyspec.com.

Assistant Administrator, Office of Federal Supply and Services, Fed. Test Method Std. 191A Change Notice 5, issued Dec. 28, 1989, pp. 10-16. from www.everyspec.com.

Miami-Dade County, Notice of Acceptance issued to Hurricane Fabric.com LLC for "Astro Guard" Flexible Wind Abatement System dated Oct. 20, 2010, with attachments dated Sep. 22, 2010. from www.miamidade.gov.

* cited by examiner

WEATHER PROTECTION SYSTEM

RELATED APPLICATION INFORMATION

This application claims the benefit of U.S. Provisional Patent Application Ser. No. 60/999,031, filed on Oct. 15, 2007, the disclosure of which is incorporated herein by reference in its entirety for all purposes.

FIELD OF THE INVENTION

This invention relates generally to severe weather protection systems; specifically, systems that include clips used to secure fabric over structural elements (e.g., doors, windows, and the like) of a structure to eliminate or at least mitigate damage that might otherwise be caused by high winds, changes in atmospheric pressure, flying debris, and the like.

BACKGROUND OF THE INVENTION

Hurricanes, typhoons, tropical storms, and other forms of severe weather have a devastating effect on the communities they strike. People who live and work in these communities need weather protection systems that effectively protect their homes, businesses, and other structures. A typical prior-art weather protection system includes metal shingles or panels that are placed over structural elements of a home, business, and/or other structure in anticipation of a severe weather event. Such systems are often heavy, cumbersome, and/or difficult to install. In addition, such systems typically require significant storage space.

Existing weather protection systems that use fabric instead of metal sheets or shingles may be somewhat lighter and easier to store than a metal shingle based system. However, such systems suffer from numerous deficiencies. Among others, such systems (1) require pre-formed grommets in the fabric, which can make it difficult to tailor a system to a particular site and/or which may introduce a point of weakness into the system, (2) use a buckle and strap system, in which buckles may loosen and require retightening during a storm, (3) may provide inadequate protection when the system sustains an impact while under a high wind load, (4) may contribute to structural damage when the system becomes subject to negative air pressure, (5) are difficult and time-consuming to customize for a particular site, and/or (6) require a relatively lengthy "lead time" for manufacturing purposes.

Thus, a need exists for a weather protection system that, (1) is relatively easy to install, (2) is relatively easy to customize for a particular site, (3) provides protection when the system sustains an impact while under a high wind load, (4) resists the forces of negative air pressure, (5) overcomes the deficiencies of prior art systems stemming from the use of a grommet system, (6) is relatively easy to store when not in use, and (7) requires a relatively short "lead time" for manufacturing purposes.

BRIEF SUMMARY OF THE INVENTION

An invention having various embodiments that meet one or more of those needs has now been developed. Embodiments of this invention include weather protection systems, methods of assembling weather protection systems, and methods of installing weather protection systems.

In one aspect, this invention concerns a severe weather protection system comprising, (a) a plurality of clips, each clip comprising a plurality of fastening points and an anchor point, (b) a plurality of fasteners, (c) coated high tenacity nylon fabric, and (d) an anchoring device. In another aspect, this invention concerns a severe weather protection system comprising, (a) a plurality of clips, each clip comprising a plurality of fastening points, an anchor point, and a plurality of resin receptacles, (b) a plurality of fasteners, (c) resin, (d) fabric, and (e) an anchoring device. In yet another aspect, this invention concerns a severe weather protection system comprising, (a) a plurality of clips, each clip comprising a plurality of fastening points, an anchor point, and a plurality of resin receptacles, (b) a plurality of fasteners, (c) resin, (d) coated high tenacity nylon fabric, (e) an anchoring device, and (f) a plurality of straps.

Furthermore, this invention concerns methods of assembling and installing weather protection systems.

These and other aspects and embodiments of this invention are more fully described below.

BRIEF DESCRIPTION OF THE DRAWINGS

The invention will be better understood from a reading of the following detailed description, taken in conjunction with the accompanying Figures in the drawings in which.

Figure 1:
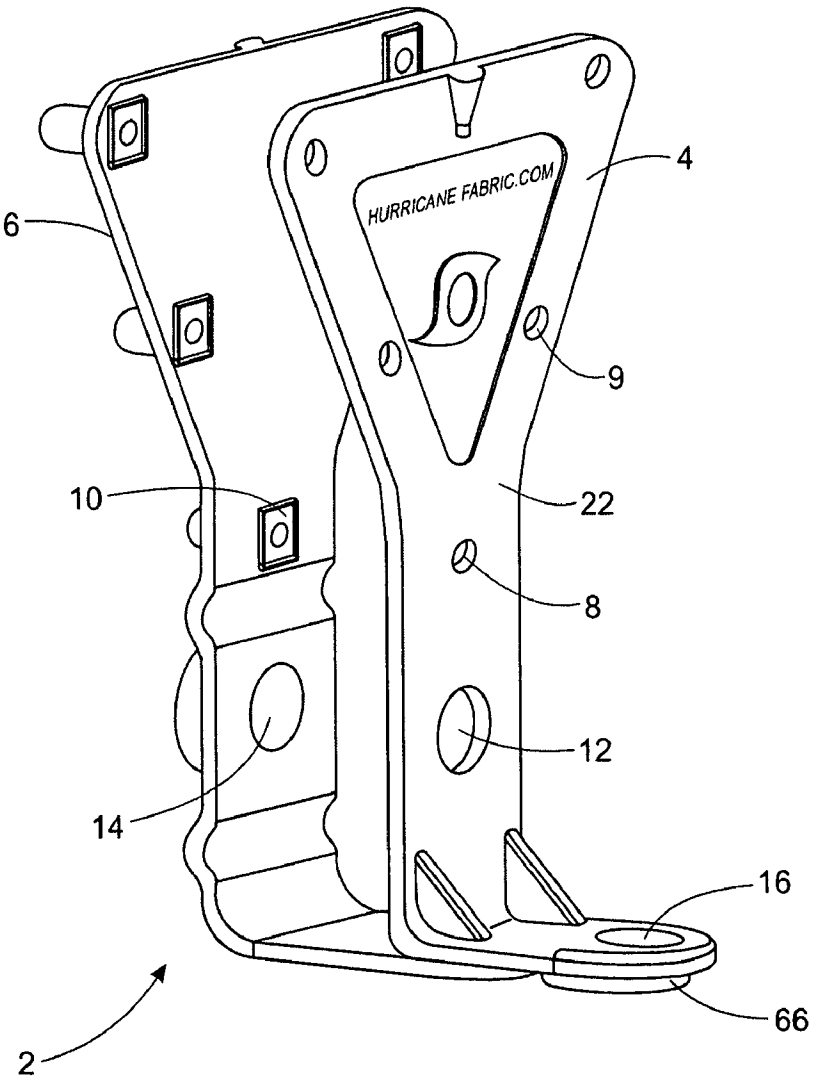
FIG. 1 is a front, left, isometric view of a first and second plate of a clip according to a first embodiment of the invention.
Figure 2:
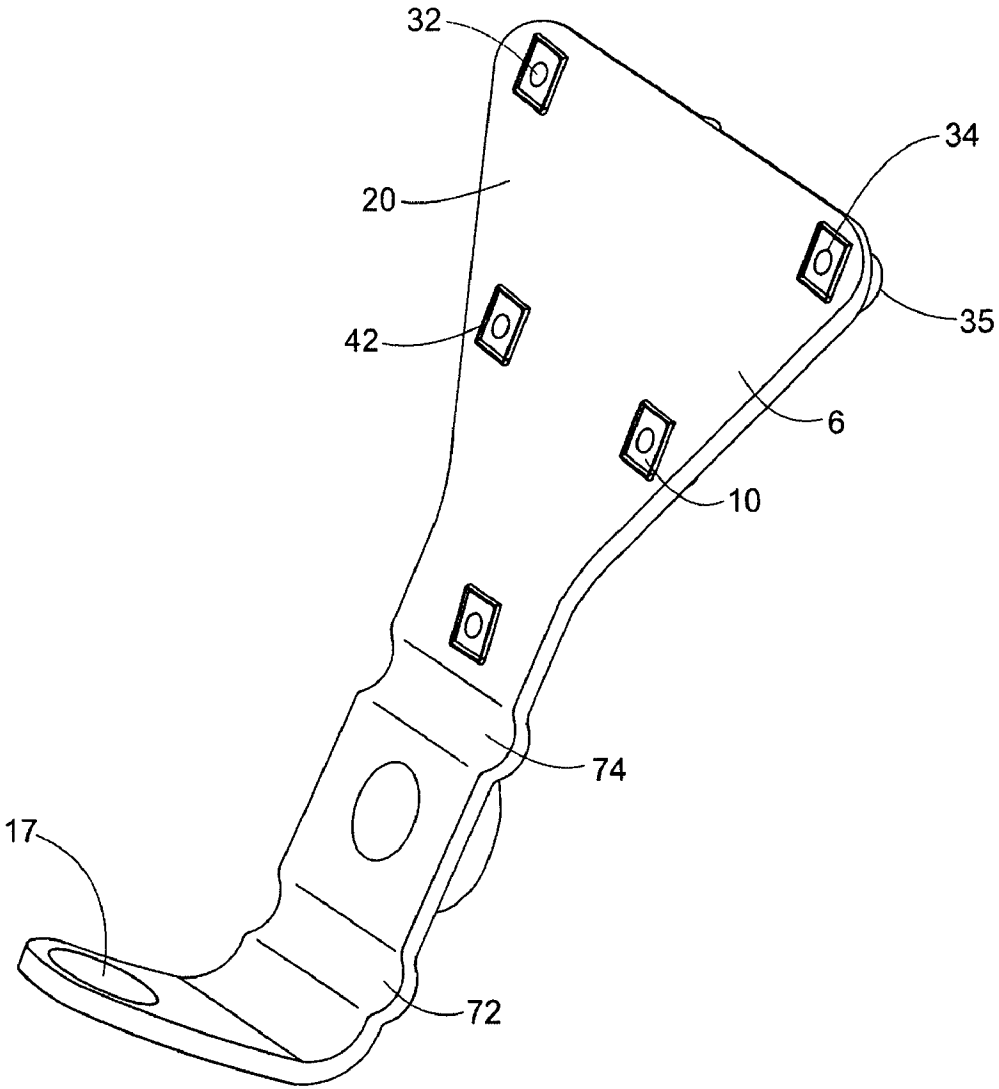
FIG. 2 is a front, right, isometric view of a second plate of the clip of FIG. 1, according to a first embodiment of the invention.

For simplicity and clarity of illustration, the figures illustrate the general manner of construction; descriptions and details of well-known features and techniques may be omitted to avoid unnecessarily obscuring the invention. Additionally, elements in the figures are not necessarily drawn to scale. For example, the dimensions of some of the elements in the figures may be exaggerated relative to other elements to help improve understanding of embodiments of this invention. The same reference numerals in different figures denote the same elements.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

DETAILED DESCRIPTION OF THE INVENTION

Severe weather, including but not limited to hurricanes, typhoons, tropical storms and other severe storms and weather events can have a devastating effect on the communities it strikes. Homes, businesses, condominiums, apartments, factories, and other residential, commercial, and/or industrial buildings or structures (individually, a "structure" and collectively, "structures") can incur significant damage.

In general, this invention provides for innovative weather protection systems that can protect a structure from damage resulting from severe weather. Furthermore, this invention provides for innovative methods of assembling and/or installing weather protection systems. As discussed in detail below, weather protection systems of this invention are installed over (or substantially over) windows, entry doors, garage doors, patio openings, porch openings, and/or other portions of a structure (individually, a "structural element" and collectively, "structural elements").

The innovative weather protection systems of this invention, and weather protection systems assembled and/or installed using an innovative method of this invention, offer significant improvements and advantages over prior art systems. Weather protection systems of this invention include one or more of the following features; specifically, such systems: (1) are relatively easy to install, (2) are relatively easy to customize for a particular site, (3) provide protection against impact while under a high wind load, (4) resist the forces of negative air pressure, (5) overcome the deficiencies of prior art systems, including those deficiencies that stem from the use of a grommet system or a buckle and strap system, (6) are relatively easy to store when not in use, and/or (7) require a relatively short "lead time" for manufacturing purposes.

In general, this invention provides for innovative weather protection systems that include, when assembled, a plurality of clips connected to fabric and, when installed, a plurality of clips connected to fabric, and a structure.

Weather protection systems of this invention comprise a plurality of clips. A clip 2 of this invention includes a first plate 4, a second plate 6, one or more fastening points 8, 10, and one or more anchor points 12, 14, 16, 17. The first and second plates 4, 6 each include an inside face 18, 20 and an outside face 22, 24. The first and second plates of a clip of this invention are adapted to be connected at one or more fastening points 8, 10 with one or more fasteners 26, such that all or a portion of the inside face 18 of a first plate 4 is opposite (and facing) all or a portion of the inside face 20 of a second plate 6.

While a substantially similar size and shape of the first 4 and second 6 plates of a clip 2 is preferred, it is not a necessary feature of the clip of this invention, so long as the first and second plates can be connected in a manner described herein. Furthermore, although separate first and second plates are preferred, the first and second plates of a clip of this invention may be formed as a single unit adapted to permit the alignment of the inside faces 18, 20 of the first and second plates 4, 6, in a manner described above, and to permit fabric 30 to be interposed between the inside faces of the first and second plates (as described below).

Preferably, a clip of a system of this invention is comprised of super tough polyamide 6,6 (more commonly known as super tough nylon) resin. For example, super tough nylon resins sold by DuPont under the Zytel trademark may be used to make a clip of a system of this invention. A clip may further comprise toughened polyamide 6,6 resin, glass fiber, carbon fiber, and/or other components similar to those of super tough nylon. Preferably, a clip of a system of this invention is manufactured using standard molding techniques known in the art, e.g., injection molding. Other molding and/or manufacturing techniques known in the art may also be used. For example, if a clip comprises carbon fiber it may be manufactured using carbon fiber molding techniques known in the art.

In certain embodiments, as discussed below in detail, a clip of this invention may include one or more elements formed as an integral part of the clip. Preferably, such integral elements are made with the same material as other portions of the clip, e.g., super tough nylon resins, and are formed during the molding (or other manufacturing) process otherwise used to create the clip. However, other embodiments may include elements of a clip that are attached, secured, and/or otherwise integrated in a separate process and/or that comprise a material that differs in some respects from the material or materials comprising other elements of the clip.

Thus, references herein to a "clip" of a system of this invention should be broadly understood and shall refer collectively (or, if appropriate given the context, individually) to the first plate and the second plate of such clip. Furthermore, references to elements that compose or that may compose a clip of a system of this invention should be broadly understood to refer to elements that compose or that may compose a first and/or second plate of such clip, except as otherwise specifically stated herein. Thus, for example, unless the context requires otherwise, reference to a "fastening point" of a clip shall refer to a fastening point of the first and/or second plate of such clip.

"Fastener" should be broadly understood and refers to a mechanism, material, structure, or other fastening device used to connect the first and second plates of a clip of this invention. A fastener of this invention is preferably: (1) durable; specifically, of sufficient strength to withstand the forces imposed on it as a component of a system of this invention during severe weather events; and (2) capable of penetrating a fabric of the system of this invention.

Suitable fasteners for use in this invention may include screws, bolts and nuts, locking pins, rivets, and other similar mechanical fastening devices known in the art (a "mechanical fastener"). A preferred fastener for use with a clip of this invention is a screw 26. A particularly preferred screw for use as a fastener in this invention is a sheet metal screw. In certain embodiments of this invention—particularly systems of this invention that comprise resin—zinc screws may be used as fasteners. In other embodiments, a fastener may comprise corrosion resistant coated carbon steel or stainless steel; particularly preferred alloys are type 304 and type 316 (as classified by the Society of Automotive Engineers). Preferably, in those embodiments of systems of this invention comprising a mechanical fastener, the yield point of the fastener is at least 40 kilopounds per square inch (ksi) and the ultimate tensile strength is at least 80 ksi. More preferably, the yield point is at least 50 ksi and the ultimate tensile strength is at least 90 ksi. However, it will be understood by those with skill in the art that preferred material or materials for use in a fastener of this system and/or other preferred characteristics of such fasteners may vary depending upon the particular application.

A fastener of this invention may comprise glue, resin, epoxy, and/or another adhesive (an "adhesive fastener"). A fastener of this invention may be a separate element (such as a screw), or it may be an "integral fastener", formed as an integral part of the first and/or second plates of a clip of this invention. The plurality of fasteners used to connect a first and second plate of a clip of this invention may include more than one type of fastener. Thus, unless otherwise specifically stated, references to a "plurality of fasteners" may refer to a plurality of substantially identical fasteners or to a plurality of fasteners comprising more than one type of fastener (e.g., screws and integral fasteners; screws and adhesive fasteners; rivets, screws, and adhesive fasteners).

A clip of this invention comprises one or more "fastening point" 8, 10. "Fastening point" should be broadly understood to refer to a point and/or area at which the first and second plates of a clip are and/or may be connected using a fastener 26 and at which fabric 30 is and/or may be interposed between such first and second plates 4, 6. As will be understood by those with skill in the art, the preferred size, shape, format, and other features of a fastening point will be determined, at least in part, by the type (or types) of fastener anticipated for use in and/or at such fastening point. Although a clip of this invention may comprise a single fastening point, a plurality of fastening points is preferred. A preferred quantity of fastening points is in the range of three to twenty. Particularly preferred quantities of fastening points include three (or at least three), six (or at least six), and eight (or at least eight).

"Fastening point" may refer to a point at which a fastener is and/or may be used to connect a first and second plate of a clip, which fastening point, prior to such connection, may have had no distinguishing feature or characteristic. Preferably, however, a fastening point is defined by one or more features prior to becoming a point of connection between a first and second plate. For example, a fastening point may comprise a hole, cavity, or other void, the aperture of which may be circular, square, oval, rectangular and/or otherwise shaped and/or formed to receive a fastener. A fastening point of a clip will typically comprise a fastening point on each of the first and second plates. The fastening points of a first and a second plate that compose a fastening point of a clip may be substantially similar to one another or they may be different. Just as not all fasteners in a plurality of fasteners of a system of this invention need be substantially similar, all fastening points of a clip need not be substantially similar.

For example, if a fastener of system of this invention is a screw, (1) a first plate 4 preferably comprises a fastening point 8 for such fastener 26 that includes a substantially circular hole 9 through the plate with a diameter at least as big as the shaft of such fastener; more preferably, the diameter of the hole composing such fastening point is somewhat larger than the shaft of such fastener, but not larger than the head of such fastener (for example, the diameter may be between approximately 0.15 and approximately 0.25 inches; a particularly preferred diameter is approximately 0.175 inches); and (2) a second plate 6 preferably comprises a fastening point 10 for such fastener 26 that includes a cavity 32 rearwardly disposed from the inside face of the second plate, wherein the cavity comprises a substantially circular opening 34 and a substantially cylindrical shaft 35, both of which have a diameter that is somewhat smaller than the shaft of that fastener (for example, the diameter may be between approximately 0.1 inches and 0.2 inches; a particularly preferred diameter is approximately 0.125 inches). In this preferred embodiment of a fastening point of the second plate, if a screw is used as fastener at such fastening point, threads to mate with those of the screw will be formed within the shaft of the fastening point when the screw is inserted into the cavity. Alternatively, the cavity can be formed with threads adapted to mate with the threads of a screw (and, in such an embodiment, the diameter of the cavity is preferably substantially equally to the diameter of the screw intended for use as a fastener at such fastening point).

In other embodiments in which a fastening point of the first plate comprises a substantially circular hole (or a hole with a shape that is other than circular), the circumference (or perimeter) of the hole may be smaller than the circumference of the fastener.

Preferably, in embodiments of this invention in which a fastening point of the second plate comprises a rearwardly disposed cavity, such cavity does not penetrate the second plate of the clip, i.e., it is not a hole. However, an open cavity, i.e., a cavity that is a hole, may be used. Furthermore, a fastening point may comprise a cavity that is not a hole, but that is or may be breached when a fastener is inserted into the cavity. A preferred external diameter of this embodiment of a fastening point is in the range of approximately 0.2 inches to approximately 0.3 inches; particularly preferred is approximately 0.25 inches. A preferred height 36 of such a fastening point (measured from the outside face of the clip comprising such fastening point) is in the range of approximately 0.2 inches to approximately 0.3 inches; particularly preferred is approximately 0.25 inches.

A fastening point may comprise a target point and/or area on the outside face of a plate that indicates (via a marking, indentation, and/or other suitable indicator known in the art) a suitable point and/or area for penetration of a fastener (such as a self-piercing rivet) through the first and/or second plates of a clip of this invention.

In an embodiment of this invention in which a fastener comprises glue, resin, epoxy, and/or another adhesive, a fastening point may comprise a target point and/or area on the inside face of a plate that indicates (e.g., via marking, indentation, and/or other suitable indicator known in the art) a suitable point and/or area for application of the fastener.

In an embodiment of this invention in which a fastener is an integral fastener, a fastening point on the plate on which the integral fastener is formed (e.g., the first plate) comprises the integral fastener. In such embodiment, a preferred fastening point on the other plate (e.g., the second plate) comprises a hole, cavity, or other void adapted to receive the integral fastener.

As will be understood from the foregoing discussion, the term "connected," as used herein, is defined as firmly attaching, joining, fixing, fastening and/or structure securing a first item to a second (e.g., a first plate to a second plate), in a removable or non-removable manner. Furthermore, a third item (e.g., fabric) may be interposed between the first and second items that are connected. In such manner, the third item is connected to the first and second items.

The clips of systems of this invention aid in achieving several objects of this invention. Specifically, among other advantages, clips of this invention (1) promote ease of installation, (2) promote customization for a particular installation site, (3) overcome deficiencies of prior-art systems, including but not limited to prior art systems comprising fabric with grommets and/or a buckle/strap system used as a connection point, (4) facilitate the ability of a system of this invention to withstand impact under high wind loads, and/or (5) facilitate a relatively short lead time for manufacturing purposes.

Some of these benefits are discussed in further detail below. Generally, however:

- When comprised of super strong nylon, clips of this invention are strong, yet somewhat flexible. This flexibility may improve the ability of a system of this invention to withstand impact while under high wind loads by providing a decelerating effect.
- In some embodiments, fasteners used in systems of this invention may penetrate the weave of the fabric with little or no damage to the fabric and, in such event do not create a weak point in the fabric and/or system.
- A clip of this invention adapted for a plurality of fasteners, when connected to fabric, may spread the force of the connection over a greater area than in a grommet system offering improvement over such prior art systems in terms of wind and/or impact resistance.
- A clip of this invention can be positioned and repositioned during assembly to optimize placement in reference to optimal locations for an anchoring device around a structural element; a prior art grommet system would include typically pre-formed grommets in the fabric that could not easily (if at all) be repositioned on site.
- As discussed below, assembling a system of this invention comprises the step, "providing fabric sized to substantially cover the structural element". By eliminating the need for grommets or other pre-formed attachment points on the fabric, systems of this invention benefit from a relatively short lead time for manufacturing purposes.

As discussed in further detail below, a preferred embodiment of a system of this invention further comprises resin. In such an embodiment of this invention, a clip of such system preferably comprises one or more resin receptacles 38, 40. "Resin receptacle" should be broadly understood and refers to a cavity, recess, walled area, and/or other chamber and/or receptacle adapted: (1) to receive resin applied to a system of this invention, and/or (2) to retain all or some portion of resin applied to a system of this invention. Preferably, a resin receptacle of this invention can be accessed to receive resin when the first and second plates of a clip are connected.

Figure 13:
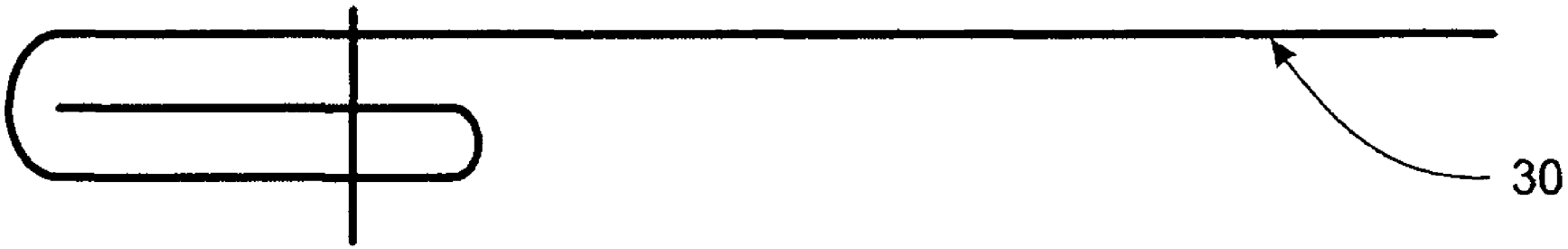
FIG. 13 is an illustration of a preferred edge treatment of a fabric of an embodiment of a system of the invention.
Figure 14:
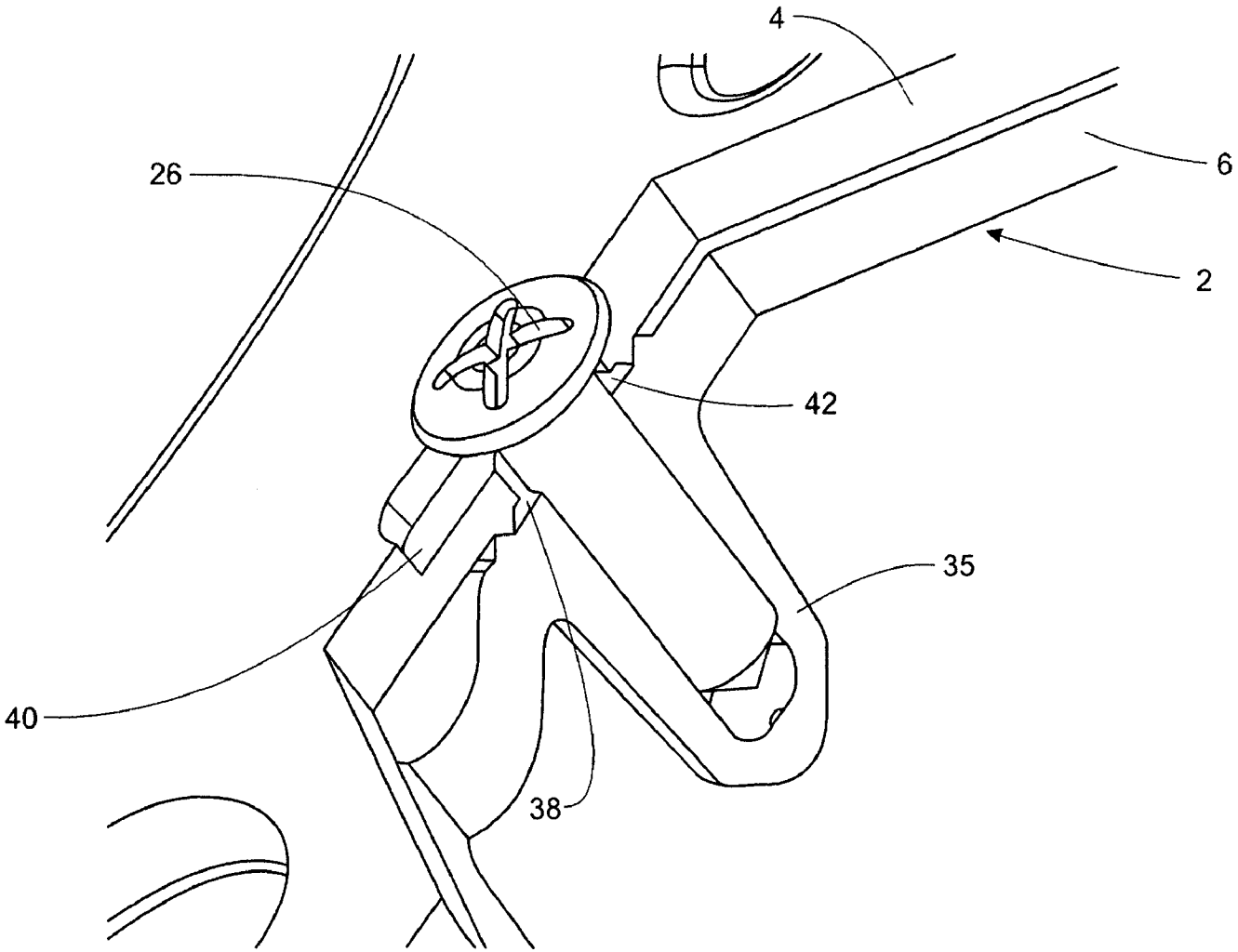
FIG. 14 is a side, cutaway view of a clip and fastener according to an embodiment of the invention.

A preferred resin receptacle is contiguous to and/or an integral part of a fastening point. More preferably, a resin receptacle is contiguous to and/or an integral part of substantially all fastening points of at least one plate of a clip. Preferred embodiments of resin receptacles of this invention include: (1) a resin receptacle 38 comprising a wall or other barrier projecting from the inside face of a plate and surrounding or substantially surrounding a fastening point 10, an embodiment of which is illustrated on FIG. 13 and/or (2) for an embodiment of a clip 2 comprising a fastening point 8 that is a hole or that becomes a hole following insertion of a fastener at the fastening point, a resin receptacle 40 comprising a recess, cavity, and/or other chamber or receptacle formed within the outside face of the plate that is contiguous to some portion or all of such fastening point, such that resin applied at or near such resin receptacle can flow into some portion or all of the fastening point 8. (See, e.g., the embodiment illustrated on FIG. 14.)

Although a resin receptacle is not a necessary feature of this invention, and other embodiments of resin receptacles may be used, the novel resin receptacles described above are particularly useful in that, in combination, they permit application of resin at or near the head of a fastener 26 (e.g., a screw) after the first and second plates 4, 6 have been connected, with fabric 30 interposed between them. The resin can then flow into the resin receptacle on the outside face 22 of a first plate 4, be contained by resin receptacles 40, 42 on the inside faces 18, 20 of the first and second plates 4, 6, and, preferably, will flow into the cavity of the fastening point 10 of the second plate 6. In such an embodiment of the novel systems of this invention, the resin preferably: (1) protects the fastener from harsh weather conditions by encapsulating and/or otherwise protecting the metal of the screw that would be exposed, absent application of the resin, and protects it from degradation (e.g., if a screw is a fastener, a less-expensive zinc screw can be used instead of a stainless steel screw, since the resin can protect the screw from exposure to harsh weather conditions); (2) protects the fabric from tearing and/or otherwise being compromised at the point of connection with the fastener; and/or (3) further binds and connects the first plate, the second plate, and the fabric.

In an embodiment of this invention in which a fastener is an integral fastener, a resin receptacle for the fastening point that comprises the integral fastener may be a hole adjacent to the integral fastener.

In an embodiment of this invention in which a fastening point of the second plate comprises a rearwardly disposed cavity, a resin receptacle associated with such fastening point may comprise such cavity.

In an embodiment of this invention comprising resin, in which the resin is provided as a pre-hardened (but flexible) patty, a resin receptacle may comprise a target point and/or area on the inside fact of a plate that indicates (e.g., via marking, indentation, and/or other suitable indicator) a suitable point and/or area for application of the resin.

The inside face of the first and/or second plate of a clip of a system of this invention may further comprise one or more engaging member 44. "Engaging member" should be broadly understood to refer to a protrusion or other projection from the inside face 18, 20 of a plate adapted to engage the weave of fabric interposed between a first and second plate 4, 6 of a clip 2. For example, a presently preferred engaging member is an integral triangular projection or tooth disposed along the inside face of a plate. More preferred is a triangular projection that is shaped substantially as a right triangle. For example, such an engaging member may have a width in the range of approximately $1/32^{nd}$ to $1/16^{th}$ of an inch, a height in the range of approximately $1/32^{nd}$ to $1/16^{th}$ of an inch, and a length in the range of approximately $1/16^{th}$ to $1/8^{th}$ of an inch.

Preferably, if a plate comprises an engaging member and a resin receptacle that comprises a wall or other barrier projecting from the inside face, the height of the engaging member at its highest point is greater than the height of the wall or other barrier comprising the resin receptacle at its highest point.

In an embodiment of a clip 2 that comprises one or more engaging members 44, engaging members may be included on the first plate, the second plate, or both the first and second plate of such clip. In an embodiment in which both the first and second plates comprise engaging members, the engaging members of the first plate are preferably arranged to be offset from the engaging members of the second plate when the first and second plates are connected at a fastening point. A preferred quantity of engaging members is in the range of ten to thirty, although quantities outside this range may also be used in embodiments of the system of this invention.

The novel system of this invention comprises a clip 34 that further comprises at least one anchor point 12, 14, 16, 17 adapted to receive an anchoring device 40, which anchoring device will connect a clip to a structure at a securing point 46.

The term "securing point" should be broadly understood and refers to and includes a point on a structure outside of the vulnerable portion of a structural element suitable for insertion and/or application of an anchoring device. Suitable securing points will be readily identified by those with skill in the art. A preferred securing point for a system of this invention is: (1) at or in a structural component of the structure, and (2) outside of, but relatively close to, the vulnerable portion of the structural element.

"Anchor point" should be broadly understood and refers to a point or area of a clip at which the clip can be connected to a structure at a securing point using an anchoring device 48, 50.

Preferably, an anchor point is not also a fastening point, i.e., it is not a point at which the first and second plates of a clip are (or will be) connected and at which fabric is (or will be) interposed between them. However, for some fabrics used in an embodiment of this invention, interposing fabric between the first and second plates of a clip at an anchor point may be acceptable. A clip of this invention, optionally, may comprise one or more connecting points—points at which a first and second plate of a clip are connected—that are not fastening points or anchor points, i.e., at which no fabric is interposed at the point of connection and which is not adapted to receive an anchoring device for connection to a structure.

A clip comprising a single anchor point may be used in a system of this invention. Preferably, a clip of this invention comprises two anchor points—a first anchor point 12, 14 and a second anchor point 16, 17, wherein a first anchor point 12, 14 lies in a first plane that is in substantially the same plane as fastening points 8, 10 of the clip 2 and wherein the second anchor point 16, 17 lies in a second plane that is substantially perpendicular to such first plane. Such a clip may further comprise a bend 52 that provides a transition between such first and second planes. Optionally, one or more reinforcing structures 54, 56 are provided at the bend 52. A reinforcing structure may comprise a wall, a thickening, a band, or other structure known in the art to provide strength at a bend or similar transition point.

An embodiment of the novel systems of this invention that comprises two anchor points aids in achieving an objective of this invention—ease and flexibility of installation. Specifically, by providing anchor points on the first and second planes, this embodiment allows an installer greater flexibility in determining which portion of a structure on or around an element is best suited for receiving an anchoring device.

Generally, each anchor point is defined by a hole 58, 59, 60, 62 through each of the first 4 and the second 6 plates of a clip 2 of this invention. Preferably, an anchor point of a clip comprises an anchor point 12, 14, 16, 17 on each of a first and second plate 4, 6 that will align when the first and second plates are connected at one or more fastening points 8, 10. However, a clip in which an anchor point of a clip comprises an anchor point on just one of the first and second plates may be used in other embodiments of the novel system of this invention.

In addition to comprising a hole to receive an anchoring device, an anchor point may further comprise features adapted to: (1) aid in positioning the first and second plates of a clip such that fastening points and/or anchor points are aligned (a "positioning feature"), (2) strengthen the anchor point, and/or (3) promote a secure connection between the clip and the structure, via the anchoring device. Optionally, an anchor point 16 on a first plate 4 may comprise one or more protrusion, wall, or other upward projection 66 from the inside face 18 of such plate adapted to be received by a corresponding anchor point 17 on the second plate 6 of such clip 2. For example, as illustrated on FIG., a first anchor point 16 of a first plate 4 may comprise an annular protrusion 66 and a corresponding second anchor point 17 of a second plate 6 may comprise a hole 62 in which the opening has substantially the same shape as, and is just slightly bigger than, the outer wall of the protrusion 66 that composes the first anchor point 16, such that the protrusion 66 of the first anchor point 16 can fit within the hole 62 of the second anchor point 17.

Figure 3:
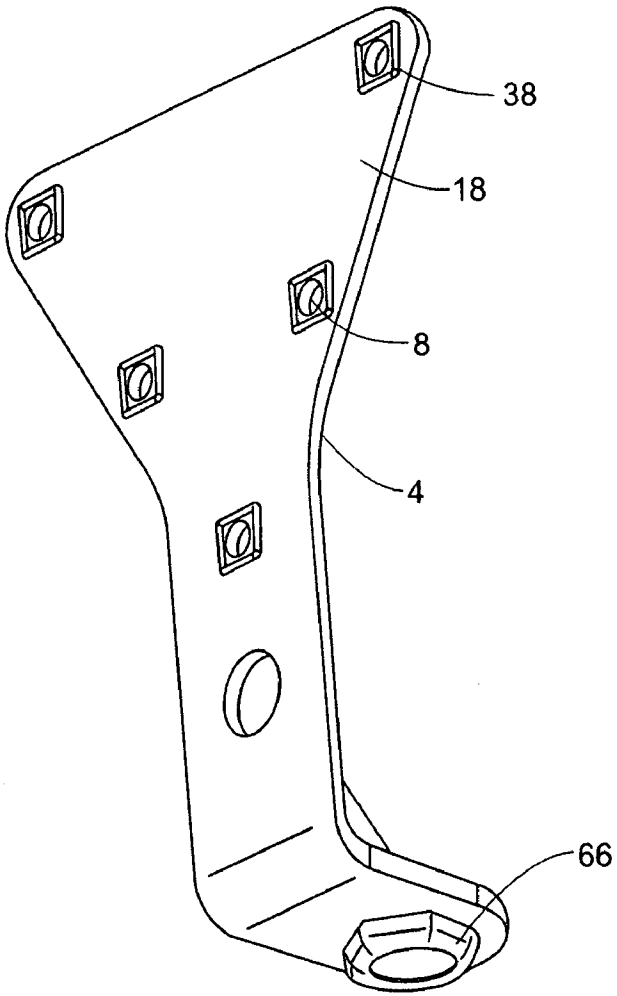
FIG. 3 is a rear, right, bottom isometric view of a first plate of the clip of FIG. 1, according to a first embodiment of the invention.
Figure 4:
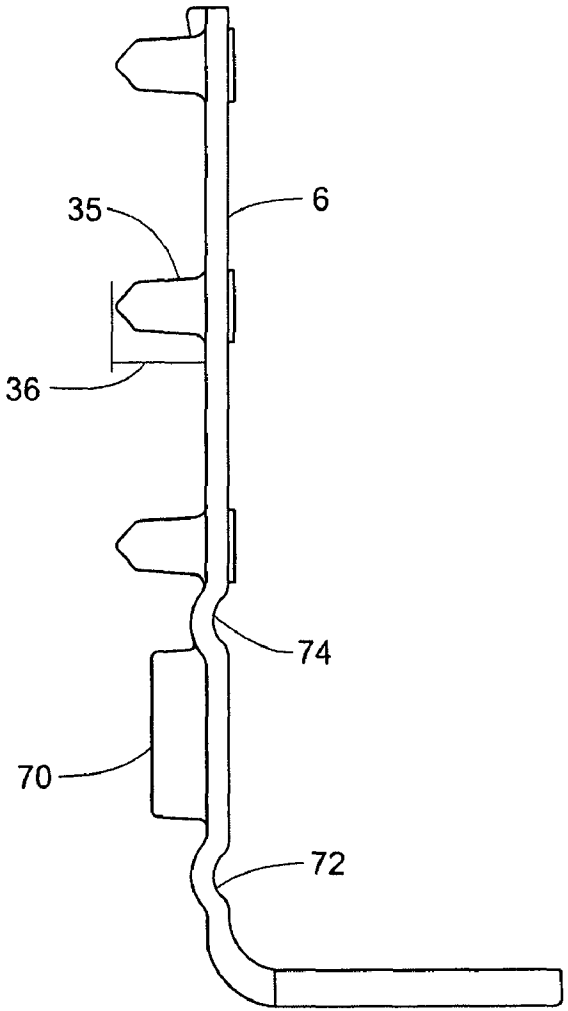
FIG. 4 is a side view of the plate of FIG. 3, according to a first embodiment of the invention.
Figure 5:
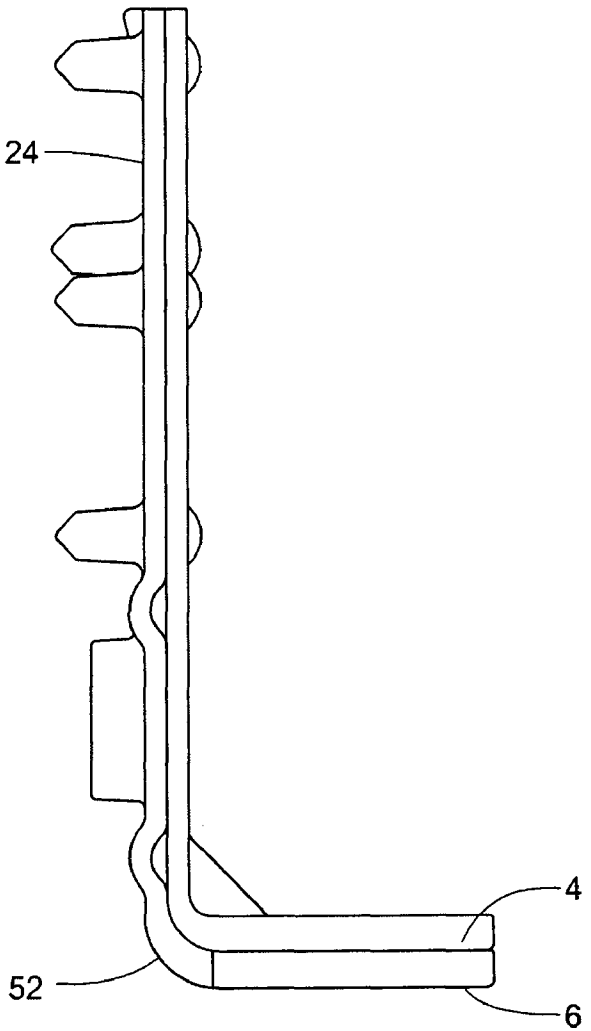
FIG. 5 is a side view of a clip and fasteners according to a second embodiment of the invention.
Figure 6:
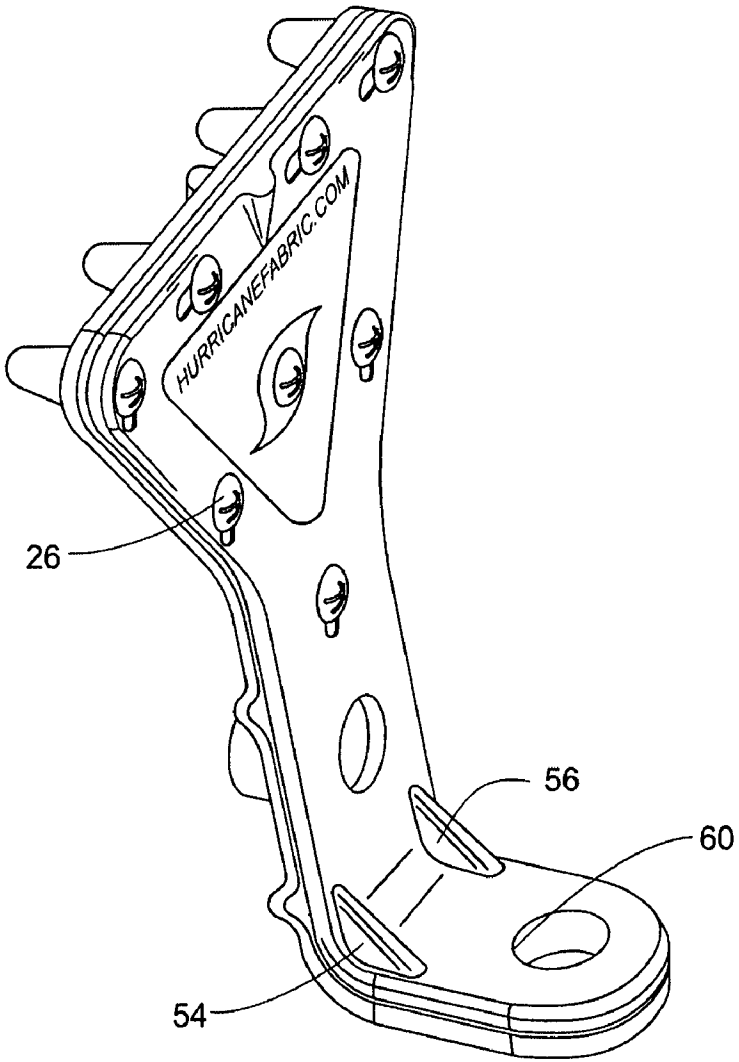
FIG. 6 is a front, right, isometric view of the clip and fasteners of FIG. 5, according to a second embodiment of the invention.
Figure 7:
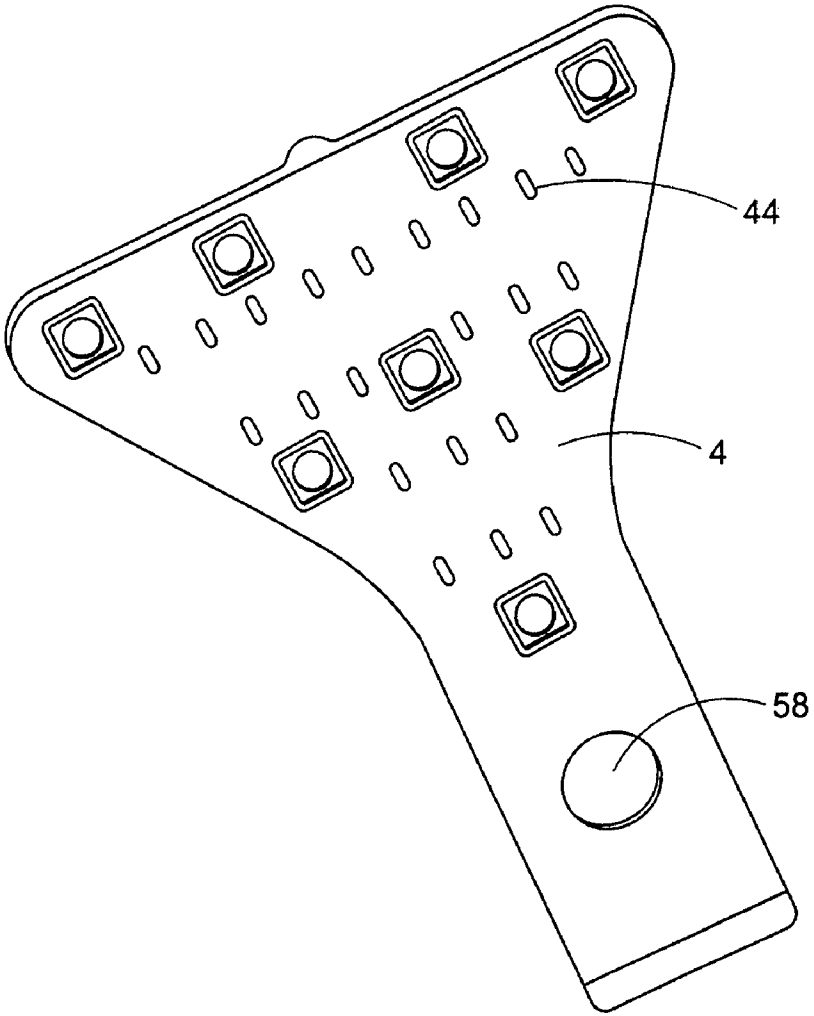
FIG. 7 is a front view of a first plate of the clip of FIG. 5, according to a second embodiment of the invention.
Figure 8:
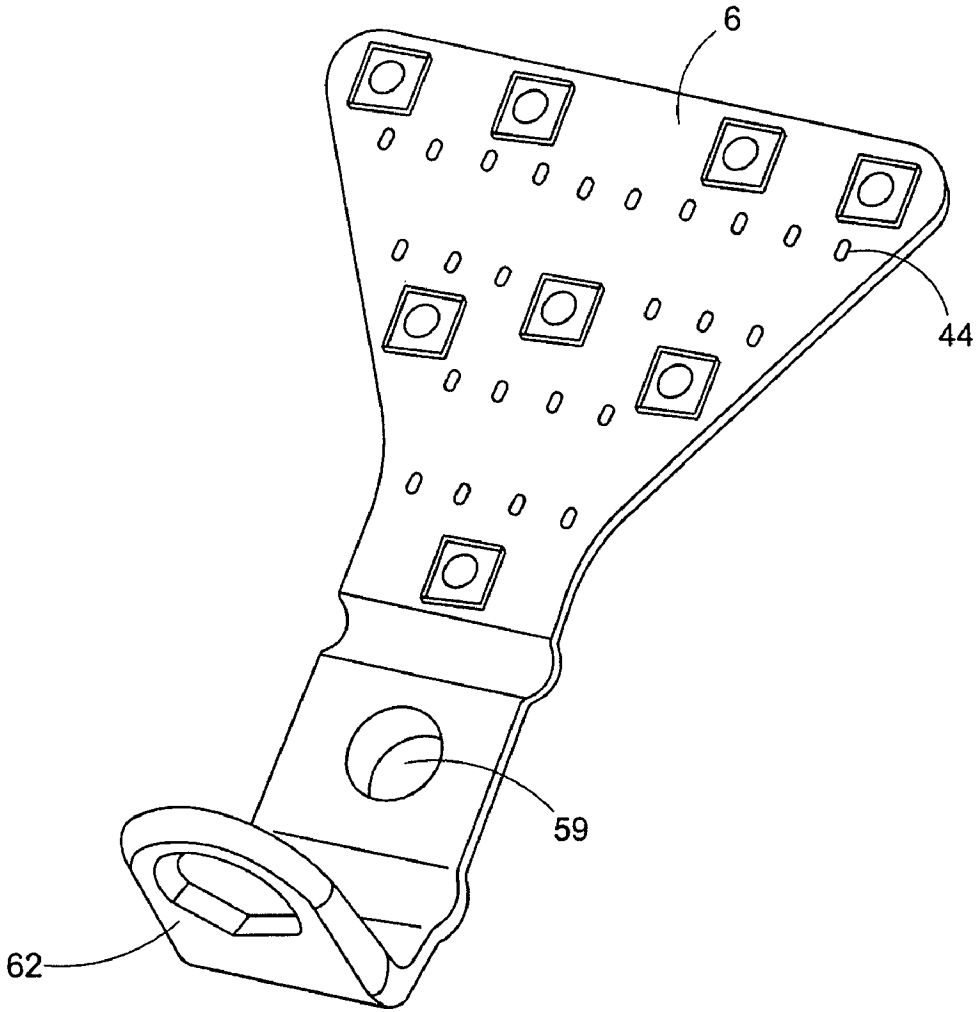
FIG. 8 is a front, right, isometric view of a second plate of the clip of FIG. 5, according to a second embodiment of the invention.
Figure 9:
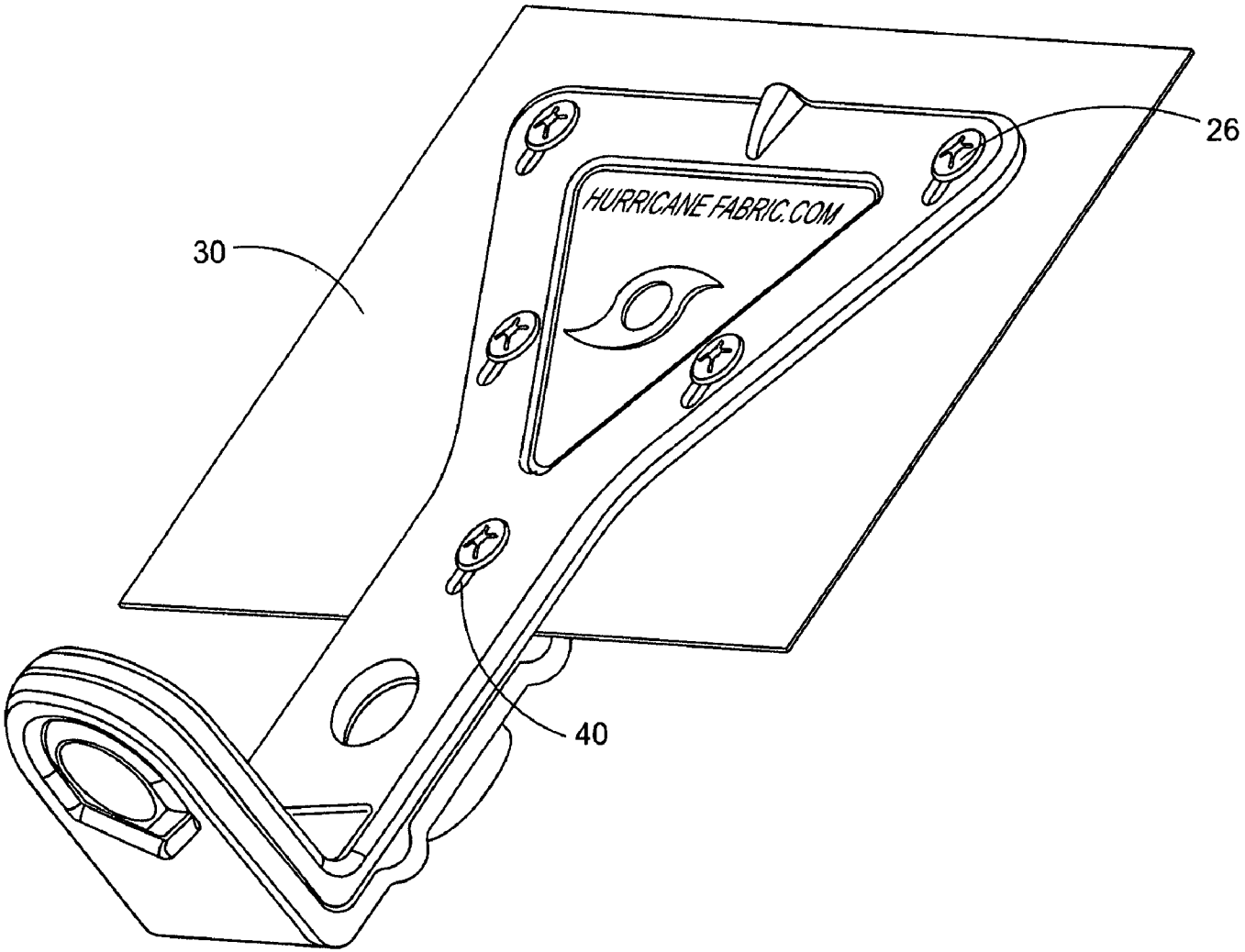
FIG. 9 is a front, isometric view of a weather protection system, according to an embodiment of the invention.

In a preferred embodiment, as illustrated on FIG. 3, the interior wall of an annular protrusion 66 of a first anchor point 16 is substantially circular, preferably with a circumference slightly larger than the circumference of the shaft of the anchoring device intended for such anchor point, and the exterior wall is lopsided; the corresponding second anchor point 17 of the second plate 6 is preferably a hole 62 the opening of which forms a shape adapted to mate with the annular protrusion 66 of the first anchor point 16, such that the projection comprising the anchor point 16 of the first plate 4 cannot easily be placed into the corresponding anchor point 17 of the second plate 6 unless the plates are properly positioned for connection at one or more fastening points 8, 10. An anchor point such as the one described above (e.g., that promotes the proper positioning of first and second plates of a clip), may be referred to as a "positioning anchor point." A clip of this invention may comprise one or more positioning elements that are not components of an anchor point.

Optionally, an anchor point 14 may include a rearwardly disposed annular protrusion, wall, column (or plurality of columns), or other stabilizing feature around a hole composing the anchor point 70. Such a feature may promote a secure connection between a clip 2 and a structure by, inter alia, minimizing the distance between the clip 2 and the structure at such anchor point 14. An anchor point 14 comprising a stabilizing feature 70 may be referred to as a "stabilizing anchor point." Preferably, the stabilizing feature of an anchor point is formed as an integral part of the clip and is made of the same material as the clip, e.g., super tough nylon. However, a stabilizing feature may be separate and/or may be made of a different material. For example, in certain embodiments, a nut or similar device may compose a stabilizing feature. A clip 2 of this invention may further include one or more troughs 72, 74 adjacent to an anchor point 14.

An anchor point of a clip preferably comprises a circular opening with an interior diameter that is slightly larger than the diameter of the shaft of the anchoring device for such anchor point. A preferred diameter is between approximately 0.3 inches and approximately 0.32 inches. For an anchor point comprising a stabilizing feature that comprises an annular protrusion 70, a preferred exterior diameter is between approximately 0.55 inches and approximately 0.7 inches; a particularly preferred diameter is approximately 0.635 inches.

"Anchoring device" should be broadly understood and refers to a mechanism, material, structure, or other anchoring device used to connect a clip of this invention to a structure. Suitable anchoring devices for use in a system of this invention will be readily identified by those with skill in the art.

A preferred anchoring device 48 for a system of this invention comprises a sidewalk bolt 76 and an insert 78 (commonly referred to as an "anchor" or an "anchoring base"). Another preferred anchoring device 50 comprises a male anchor, with alternately threaded portions 84, 86, and a nut 88 (e.g. a wing nut or hex head nut). For example, inserts, sidewalk bolts, and male anchors sold under the trademark PanelMate may be used as a component of an anchoring device of a system of this invention. As is known in the art, the specific features preferred for an anchoring device will depend in part on the material into which the anchoring device will be placed when a system of this invention is installed. For example, a presently preferred length for an anchoring device to be inserted into wood is approximately 2 inches a presently preferred length for an anchoring device to be inserted into concrete is approximately 1¼ inches. A preferred diameter for a sidewalk bolt 76 comprising an anchoring devise is approximately ¼ inches; a preferred diameter for a male anchor 82 comprising an anchoring devise is approximately ½ inch.

Other bolts, anchors, and the other mechanisms, with a preference for mechanisms adapted for use in severe weather protection systems, may be used in a system of this invention. Stainless steel and carbon steel are preferred materials for an anchoring device of this invention.

A wide range of sizes and shapes may be used for a clip of this invention. In one preferred embodiment of a clip of this invention, the clip comprises a head portion and an anchor portion in which the head portion is somewhat wider than the anchor portion. In one embodiment, the shape of the head portion is generally triangular and the anchor portion is generally rectangular. In such an embodiment, the clip 2, at the top of the head portion may be between 2 and 4 inches wide, tapering to an anchor portion that is between ¾ and 2 inches wide. Of course, these are merely examples and many other shapes and/or sizes may be used for a clip of this invention. Preferably, one or more fastening point 8, 10 is located within a head portion; optionally, one or more fastening point may be located within an anchor portion. Preferably, one or more anchor point 12, 14 is located within an anchor portion; optionally, one or more anchor point may be located within a head portion.

In a preferred embodiment in which the fastening points 8, 10 and a first anchor point 12, 14 are located in a first plane, and a second anchor point 16, 17 is located in a second plane, a preferred length of the clip 2 in the first plane is between 3½ and 6 inches (particularly preferred is between 4 and 5 inches) and a preferred length of the clip 2 in the second plane is between 1 and 2 inches. A preferred thickness for the clip in the first plane (excepting resin receptacles and other features) is in the range of approximately 0.1 inches to approximately 0.15 inches; a preferred thickness for the clip in the second plane is in the range of approximately 0.1 to approximately 0.15 inches.

In a preferred embodiment of a clip 2 of this invention, the clip is preferably somewhat flexible, such that when a clip is secured to a structure with an anchoring device 80, 82 at an anchor point 12, 14, 16, 17 of the clip 2 and a securing point 46 of the structure, the clip 2 will bend or otherwise exhibit flexibility between such anchor point 12, 14, 16, 17 and some portion or all of the clip 2 comprising fastening points 8, 10 (e.g., the head portion). Such an embodiment of a clip 2 of this invention may further disperse wind loads and/or impact forces applied to the system during a severe weather event. This preferred flexibility may be introduced by the material comprising a substantial portion of the clip, e.g., super tough nylon exhibits flexibility; alternatively (or in addition) other methods of introducing flexibility may be used, e.g., springs imbedded in the clip at a point (or points) between an anchor point and the head portion.

Optionally, a system of this invention comprises one or more straps 94. Upon installation, as more particularly described below, a system of this invention will cover a structural element, with clips 2 connected to the structure at securing points 46 on opposing sides of the structural element. The distance between and including such opposing clips of an installed system of this invention is sometimes referred to herein as the "secured span" 96. In an embodiment of a system of this invention that comprises one or more straps, a strap 94 is provided that is sized to fit the secured span 96.

Materials appropriate for a strap of a system of this invention include (1) fabrics woven in twill or satin fabrication from high tenacity polyester yarns (such as fabrics commonly used for seat belts), (2) synthetic rubber (e.g., a synthetic rubber comprising polychlorophrene, including those commonly referred to as neoprene), and (3) other fabrics and/or materials known in the art to have similar characteristics.

A strap 94 of a system of this invention comprises at least two strap connection points. "Strap connection point" refers to the point at which the strap is adapted to be connected to an anchoring device 80, 82 at a securing point 46 of the structure. A strap connection point may comprise a hole in the strap, optionally protected by a grommet, or other structure suitable for attaching a strap to an anchoring device. The securing point at which a strap is connected to a structure via an anchoring device may be, and preferably is, the same securing point used to connect a clip of a system of this invention to a structure. Similarly, the anchoring device used to connect a strap to a structure at a securing point may be, and preferably is, the same anchoring device used to connect a clip to the structure at such securing point. However, in other embodiments of systems of this invention, a second set of securing points and second set of anchoring devices (e.g., securing points and anchoring devices not used to connect a clip to a structure) may be provided to facilitate connection of a strap to a structure.

A strap is "sized to fit the secured span" when the distance between two strap connection points is approximately equal to or greater than the length of the secured span 96. One strap may be sized to fit the secured span of more than one secured span length. For example, a plurality of strap connection points may be provided on one or both ends of a strap, so that a single length of strap can be sized to fit a plurality of secured spans.

An embodiment of a system of this invention that comprises a plurality of straps aids in achieving one or more objects of this invention. Among other benefits, a system of this invention comprising straps may (1) reduce the risk of damage from negative air pressure, and/or (2) improve the ability of the system to withstand high wind loads and/or impact. For example, when a structure is subject to negative air pressure (i.e., the atmospheric pressure inside the structure is significantly lower than the outside atmospheric pressure) during a severe weather event, fabric 30 that comprises a system of this invention may be drawn toward the interior of the structure, i.e., the fabric may become convex, putting the covered element of the structure at risk of damage from the fabric and/or putting the system at risk of pulling away from the structure and toward the interior of the structure at one or more anchor points; straps may mitigate this risk. When a system of this invention comprising a plurality of straps is subjected to a high wind load, the straps may reduce and/or disburse the wind load on the fabric, which may allow such a system of this invention to withstand a greater wind load before failing.

Preferably, a strap is connected to a clip at an anchor point 12, 14, 16, 17, and the anchoring device 80, 82 used in such anchor point will connect the strap to the clip, when such an embodiment of a system of this invention is installed.

A system of this invention comprises fabric 30. As will be understood by those with skill in the art, fabric of a weather protection system will have certain preferred characteristics directed to the ability of the fabric to withstand high winds and impact. Furthermore, it will be understood by those with skill in the art that a substantially closed weave is preferred to prevent passage of wind-borne objects through the open portions (e.g., interstices) of the fabric. In some instances, characteristics of a preferred fabric may be influenced by laws, regulations, and/or other guidelines applicable to a particular structure, a particular structural element, and/or the particular geographic area in which a structure is located. For example, a jurisdiction may require that a weather protection system for use during severe weather events (e.g., hurricanes) must (1) prevent passage of objects 3/16" of an inch or greater in size and/or (2) be able to withstand a force of 61.3 psi before failure.

This invention provides novel weather protection systems and novel methods of assembling and installing weather protection systems that, in certain embodiments, comprise fabric with characteristics similar to fabrics used in prior art weather protection systems, e.g., the weather protection system described in U.S. Pat. No. 6,325,085, incorporated herein by reference. In other embodiments, this invention provides novel weather protection systems and novel methods of assembling and installing weather protection systems that comprise fabrics that are novel and non-obvious for use in a weather protection system.

A fabric of the present invention may comprise one or more of the following characteristics: (1) an elongation (i.e., the stretch of the fabric just prior to failure) of not more than 25%, (2) a minimum open area of not more than 10%; (3) a bursting strength, when measured using an American Society for Testing and Materials ("ASTM") D3787 ball burst test (a "ball burst strength"), of at least 500 pounds per square inch ("psi"); (4) a tensile strength, when measured using an ASTM D4632 test for grab breaking load (a "tensile strength"), of at least 400 pounds for the warp fibers and at least 300 pounds for the weft fibers; (5) a bursting strength, when measured using the ASTM D3786 diaphragm bursting strength test (a "diaphragm burst strength"), of at least 700 psi; (6) a tear strength, when measured using ASTM D4533 test for trapezoidal tearing strength (a "tear strength"), of at least 150 pounds for the warp fibers and at least 120 pounds for the weft fibers; (7) an abrasion resistance, when measured using an ASTM D4886 test for abrasion resistance (an "abrasion resistance"), of at least 85% strength retained; (8) a puncture resistance, when measured using an ASTM D4833 test for puncture resistance (a "puncture resistance") of at least 130 pounds; (9) air flow of not more than 350 cubic feet per minute; and/or (10) an ultra violet retention, when measured using an ASTM G154 method of reproducing the weathering effects that occur when materials are exposed to sunlight and moisture as rain or dew in actual usage (a "uv retention") of not less than 80%.

In another embodiment, a fabric of a system of this invention may comprise one or more of the following characteristics: (1) an elongation of no more than 20%, (2) a minimum open area of not more than 5%; (3) a ball burst strength of at least 600 psi; (4) a tensile strength of at least 500 pounds for the warp fibers and at least 400 pounds for the weft fibers; (5) a diaphragm burst strength of at least 800 psi; (6) a tear strength of at least 175 pounds for the warp fibers and at least 150 pounds for the weft fibers; (7) an abrasion resistance of at least 90% strength retained; (8) a puncture resistance of at least 160 pounds; (9) air flow of not more than 275 cubic feet per minute; and/or (10) a uv retention of not less than 85%.

In a preferred embodiment, a fabric of a system of this invention comprises one or more of the following characteristics: (1) an elongation of no more than 20%, (2) a minimum open area of not more than 5%; (3) a ball burst strength of at least 600 psi; (4) a tensile strength of at least 540 pounds for the warp fibers and at least 425 pounds for the weft fibers; (5) a diaphragm burst strength of at least 825 psi; (6) a tear strength of at least 200 pounds for the warp fibers and at least 170 pounds for the weft fibers; (7) an abrasion resistance of at least 95% strength retained; (8) a puncture resistance of at least 190 pounds; (9) air flow of not more than 230 cubic feet per minute; and/or (10) an ultra violet retention of not less than 90%.

Other preferred characteristics of a fabric for use in a system of the present invention include: (1) relatively easy to cut, (2) relatively easy to mount, (3) water resistant, and (4) an interstices size of not more than approximately $3/16^{th}$ of an inch.

Yarns (fibers) that may be used to create a fabric of this invention, include but are not limited to yarns comprising polypropylene, polyethylene (for example, polyethylene fibers sold under the brand names Dyneema and Spectra), polyamides, polyimide, glass, polyolefin, ethylene-propylene rubbers, butyl rubbers, styrene-butyl rubber or butadiene co-polymers, polyethylene sulphyonyl chlorides, acrylics, polyvinyl chlorides, polyesters, cottons, yarns sold under the brand names Vectran, Kevlar, or Twaron, and/or combinations thereof.

A preferred fabric for use in a system of this invention (a "polypropylene fabric") comprises polypropylene yarn with a denier in the range of 500 to 1000. A particularly preferred denier is approximately 600. A preferred weave is a basket weave; particularly preferred is a 3 by 4 basket weave. However, other weaves that produce a fabric with the necessary characteristics may be used as a fabric in a system of this invention. One preferred fabric for use in a system of this invention is a polypropylene, 3 by 4 basket weave; particularly preferred is a polypropylene 3 by 4 basket weave with approximately 60 ends per square inch for the warp, approximately 50 ends per inch for the weft, and a weight of approximately 7.6 ounces per square yard.

If a fabric used in a system of this invention is susceptible to fraying, the edges are preferably stitched. A preferred method of stitching (specifically, a ½ inch tri-fold around the perimeter of the fabric) is illustrated on FIG. 11; preferably, the stitching is accomplished in one continuous sewing. A preferred thread is a 138 denier polyester thread stitched at intervals of ½ millimeter. Other edge finishes know in the art (or no edge finish) may also be used for a fabric used in system of this invention. For example, edges may be serged or heat cut. In one embodiment, a fabric used in a system of this invention is cut with a laser, which laser also seals the edge of the fabric as it is being cut.

Another preferred fabric for use in weather protection systems of this invention comprises polyamide yarn (commonly known as nylon). Polyamide yarn exhibits high tensile strength and relatively low elongation; thus, it exhibits characteristics preferred for a fabric of this invention. Preferably, in an embodiment of this invention in which the fabric comprises polyamide yarn, the yarn is in the range of 300 denier to 6,000 denier. Particularly preferred is a 1680 denier yarn, such as the yarn sold as "type 728" from INVISTA, a subsidiary of Koch Industries, Inc. Preferred weaves for a nylon fabric of a system of this invention are plain, twill, satin, and leno; plain weave is particularly preferred. Yarn counts are preferably in the range of 5 yarns per inch in the machine direction and 5 yarns per inch in the cross-machine direction to 70 yarns per inch in the machine direction and 70 yarns per inch in the cross-machine direction; a particularly preferred yarn count is 20 yarns per inch in the machine direction and 20 yarns per inch in the cross-machine direction.

A nylon fabric comprising a denier and yarn count in the ranges listed above with a weave listed above (a "high tenacity nylon fabric") exhibits many of the desired characteristics of a fabric of this invention; however, it is very difficult to cut. If a high tenacity nylon fabric is coated, it can become much easier to cut. For example, if a high tenacity nylon fabric is coated by dipping the fabric in solvent-based or water-based emulsions of acrylic or styrene acrylic, and then drying the fabric, the resultant "coated high tenacity nylon fabric" is relatively easy to cut and exhibits other preferred features, such as ease of mounting and water repellency. Furthermore, a coated high tenacity nylon fabric does not require treatment of the edges when cut to prevent or mitigate fraying; accordingly such fabric can be cut "on-site" (rather than cut with concurrent or subsequent edge treatment "off-site" in accordance with provided measurements). Thus, when a coated high tenacity nylon fabric is used in a novel system of this invention, it is particularly suited to achieve one or more objects of this invention; specifically, (1) customization for a particular site—fabric sized to substantially cover a structural element can be provided on-site, nearly contemporaneously with the step of measuring the structural element (as described below), and/or (2) relatively short "lead time" for manufacturing purposes—for those fabrics of this invention in which some form of edge finish or treatment is preferred, after a structural element has been identified and measured (as described below), the measurement may be provided to a third party for creation of fabric sized to substantially cover the structural element that comprises the preferred edge treatment; however, when a system of this invention comprises coated high tenacity nylon, such fabric may be provided, e.g., as a bolt, and sized to substantially cover a structural element on site.

A particularly preferred acrylic coating is a coating comprising an acrylic coating sold by Unichem, Inc. under the name UNIBOND SA 240, described by Unichem as "a formaldehyde free, anionic aqueous dispersion of an acrylic ester, styrene copolymer." In one embodiment, an acrylic coating comprises 70 parts water and 30 parts Unibond SA 240, preferably prepared by adding the Unibond SA 240 to the water and mixing at 250 rpm for no more than 5 minutes. In another embodiment, an acrylic coating comprises 75 parts Unibond SA 240 and 25 parts water, preferably prepared by adding the water to the Unibond SA 240 and mixing at 250 rpm for no more than 5 minutes.

Other coatings that may be used to produce a coated high tenacity nylon fabric include, but are not limited to, polyvinyl chloride, epoxies, polyurethanes, synthetic and natural resins and their copolymers, and polyvinyl acetates and their copolymers. Other coating techniques known in the art may be used to produce a coated high tenacity nylon fabric, such as rolling or brushing.

Preferably, as a result of the coating process, a high tenacity nylon fabric will have a "pick up" of solids in the range of 10% to 35% (or in the range of 0.7 oz/square yard to 1.2 oz/square yard).

A system of this invention preferably comprises resin. A preferred resin for use in a system of this invention is a completely non-porous ceramic resin that is a liquid upon mixing a first and second mixture and that, after solidifying, remains flexible. It may also be possible to use a substantially non-porous ceramic resin in a system of this invention. In a preferred embodiment, the resin is produced using one of the methods described in U.S. Pat. Nos. 6,110,996 and/or 6,994,891, each of which is incorporated herein by reference. Embodiments of such preferred resins have been marketed under the names Ginsite, ECO Marine Resin A, and ECO Marine Resin B, and may be produced using one of the following methods (from U.S. Pat. No. 6,110,996):

> In one method, an epoxy resin first mixture is combined with an epoxy hardener second mixture. The second mixture is homogenized and has pressurized air added. The first and second mixtures can be produced and either used immediately or stored for future use . . . .

The first mixture preferably comprises an epoxy resin, a lightweight aggregate, and a UV absorber. The preferred epoxy resin is a derivative of bisphenol A and epichlorohydrin although other resins known in the art can be used. The epoxy resin is preferably in an amount of about a range of from about 55% to about 65% by weight of the first mixture. The lightweight aggregate can comprise vermiculite, perlite or lime deposit material. Preferably, the lightweight aggregate is in an amount of about a range of from about 28% to about 32% by weight of the first mixture. The UV absorber is preferably a substituted hydroxyphenyl benzotriazole, in an amount of about a range of from about 2% to a range of from about 3% to about 5% by weight of the first mixture, available under the tradename, TINUVIN 213®. Preferably, the first mixture further comprises small amounts of sodium bicarbonate and a viscosifier, the sodium bicarbonate in an amount of a range of from about 3% to about 5% by weight of the first mixture and the viscosifier in an amount of a range of from about 2% to a range of from about 3% to about 5% by weight of the first mixture. The viscosifier is preferably an acrylic ester polymer commonly sold under the tradename, ACRYLOIDO®.

The first mixture is mixed in a rotary mixer rotating at a speed of at least 40 rpm, preferably 60 rpm. The mixing time is preferably from 5 to 40 minutes, more preferably 15 minutes but can be increased as known in the art. The temperature is ambient temperature.

The second mixture comprises an epoxy hardener, a lightweight aggregate, and a UV absorber. The second mixture is mixed in a rotary mixer, preferably a centrifugal disc mixer as described above at a speed of at least 1000 rpm for about 10 to 50 minutes, preferably 15 minutes. During the mixing, pressurized air is pumped in until the second mixture is homogenized. The pressurized air can be pumped in at a pressure within a range of from 1 psi to 3 psi for a time period ranging from about 5 minutes to about 10 minutes, about 8 minutes is preferred. The temperature is ambient temperature. Preferably the second mixture further comprise sodium bicarbonate and a viscosifier, such as an acrylic ester polymer sold as ACRYLOIDO® for example. One preferred second mixture comprises a fatty acid polyamide and triethylenetetramine.

In a preferred embodiment, the second mixture comprises the epoxy hardener in an amount of 60% by weight of the second mixture, the lightweight aggregate, vermiculite or perlite for example, in an amount of 30% by weight of the second mixture, the sodium bicarbonate in an amount of a range of from about 3% to about 5% by weight of the second mixture, the viscosifier, in an amount of a range of from about 2% to a range of from about 3% to about 5% by weight of the second mixture and in the UV absorber in an amount of a range of from about 2% to a range of from about 3% to about 5% by weight of the second mixture. The epoxy hardener comprises an amine. The preferred epoxy hardener is available under the tradename, EPI-CURE® and comprises amine, clarified gar and other viscosifying agents. The first and second mixtures can be stored for future use in manufacturing building products. The mixtures can be made in five-gallon quantities for ease of handling and storing. The first mixture and second mixture are each separately packed and sealed in drums or cans. When the user is ready to manufacture the building material, the first mixture and the second mixture are combined . . . . The ratio of the first mixture to the second mixture is a one to one ratio.

In a preferred resin of the present invention comprising a first mixture and a second mixture, the first and second mixture are combined prior to application to a system of the present invention. Combination of the first and second mixture may be accomplished in any manner known in the art; a preferred method of combining the first and second mixture is by stirring. Resin can be provided in a pre-dried form, e.g., pre-mixed and formed into a patty or other form suitable for application to a clip and/or fastener at one or more fastening points.

This invention further provides methods of assembling and/or installing a weather protection system. Preferably, (1) a system of this invention is assembled in advance of a severe weather event, and (2) when a severe weather event is forecast, an assembled system of this invention is installed to protect a structure from damage resulting from the severe weather event. However, a system of this invention may be both assembled and installed in anticipation of a severe weather event. Furthermore, as described in further detail below, assembly of a system of this invention may include some or all steps that preferably compose installation of the system, e.g., to evaluate clip placement and/or fit. Similarly, methods of installing a system of this invention may comprise one or more steps of methods of assembling a system of this invention.

A preferred method of assembling a system of this invention comprises the following steps: (1) identifying a structural element; (2) measuring the structural element; (3) providing fabric sized to substantially cover the structural element; (4) providing a plurality of clips 2 and fasteners 26; (5) connecting a clip 2 to the fabric 30 using one or more fasteners 26; and (6) repeating steps (5) with the remaining clips.

The term "identifying a structural element" and the like should be broadly understood and include and/or refer to situations where a party assembling a system of this invention has e.g., selected or otherwise identified a structural element to be protected by a system of this invention from or otherwise based on the party's own observations and/or the observations, directions, and/or instructions of one or more third parties.

"Measuring a structural element" may be accomplished by any manner known in the art, e.g., by measuring using a tape measure, by referring to specifications provided by a third party, and the like. Accordingly, "measuring a structural element" and the like should be broadly understood and include and/or refer to situations where a party assembling a system of this invention has gathered, identified, and/or otherwise determined the measurements of the structural element from or otherwise based on the party's own observations and/or actions and/or the observations and/or actions of one or more third parties. "Measurements of the structural element" refer to those measurements understood by those with skill in the art to be relevant for purposes of assembling and or installing a system of this invention at such structural element, e.g., height, width, circumference, and the like. It will be further understood by those with skill in the art that such measurements may take into consideration preferred securing points 46 for a system of this invention.

Preferably, when a system of this invention is used to protect a structural element, the fabric composing such system will substantially cover or, more preferably, completely cover, the vulnerable portion of such element, e.g., the glass, screen, and/or open portion of a window or other structural element. Thus, "fabric sized to substantially cover the structural element" should be broadly understood to refer to fabric that will substantially cover (or, preferably, completely cover) the vulnerable portion of such element when such system is installed over such element. Fabric may be "sized to substantially cover the structural element" in any appropriate manner and the term should be broadly understood. For example, (1) fabric may be woven, manufactured, cut, or otherwise created and/or provided in a size that will substantially cover the structure element at a factory, manufacturing facility, or other location separate from the structure; (2) fabric may be cut to a size that will substantially cover the structure element on-site (e.g., at or near the structure); and/or (3) fabric may be "sized to substantially cover the structural element" by folding the fabric so that, as folded, the fabric will be sized to substantially cover the structural element. Finally, in some embodiments, it may be preferable to use more than one piece of fabric to cover (or substantially cover) a single structural element. Accordingly "fabric sized to substantially cover the structural element" may refer to two or more pieces of fabric that, together, are sized to substantially cover the structural element. When fabric is "sized to substantially cover the structural element", it is preferably sized so that, when installed, the fabric is of "medium" taughtness; generally, it is preferably to have fabric that is more taught for relatively larger secured spans. Typically, fabric will be "sized to substantially cover the structural element" based on measurements of the structural element provided by the party assembling a system of this invention, a third party, and/or based on other measurements, such as manufacturer specifications of structural elements and/or standard measurements of certain structural elements.

The term "providing fabric sized to substantially cover the structural element" and the like should be broadly understood and include and/or refer to situations where a party assembling a system of this invention has e.g., received, obtained, or is otherwise providing fabric sized to substantially cover the structural element and/or in which a third party has received, obtained, or otherwise provided to the party assembling a system of this invention fabric sized to substantially cover the structural element (which fabric may have been and/or may be sized to substantially cover the structural element by such party and/or a third party).

The term "providing a plurality of clips and fasteners" and the like should be broadly understood and include and/or refer to situations where a party assembling a system of this invention has e.g., received, obtained, or is otherwise providing clips and/or fasteners and/or in which a third party has received, obtained, or otherwise provided a plurality of clips and/or fasteners to the party assembling a system of this invention.

The term "connecting a clip to the fabric using one or more fasteners" and the like should be broadly understood and include and/or refer to any situations, steps, and/or other circumstances resulting in the connection of the first plate of the clip 4, the second plate of the clip 6, and the fabric 30, with the fabric interposed between the first and second plate, using a fastener 26 to cause and/or otherwise facilitate such connection. Preferably, the step "connecting a clip to the fabric using one or more fasteners" further comprises the following steps: (i) placing a portion of the fabric 30 between a first and second plate of a clip 2; and (ii) inserting a plurality of fasteners 26 through a plurality of fastening points 8, 10 to connect the first plate 4, the fabric 30, and the second plate 6 of a clip 2

The term "placing a portion of the fabric between a first and second plate of a clip" should be broadly understood and include and/or refer to any situations, steps, and/or other circumstances resulting in fabric interposed between a first and second plate of a clip, such that a fastener 26 will pass through and/or into (a) a fastening point 8 in the first plate 4 of the clip 6, (b) the fabric 30, and (c) a fastening point 10 of the second plate 6 of the clip 2. Although not a necessary element to the step of placing a portion of the fabric between a first and second plate of a clip, such step is preferably facilitated by using a board or other mold containing one or more features adapted to receive a first and/or second plate of a clip (a "placement tool"), such that a first and/or second plate of a clip can be steadied while fabric is positioned over such plate. A placement tool may comprise a plurality of such features; for example, such features may be spaced on the placement tool at one or more preferred spacing distances for clips of an assembled system of this invention (as discussed further below).

"Placing a portion of the fabric between a first and second plate of a clip" should refer to situations where a party assembling a system of this invention has performed all of the steps that result in fabric 30 interposed between a first 4 and second plate 6 of a clip 2, such that a fastener 26 will pass through and/or into (a) a fastening point 8 in the first plate 4 of the clip 2, (b) the fabric 30, and (c) a fastening point 10 of the second plate 6 of the clip 2, as well as to situations where a third party has performed one or more of the steps that result in fabric 30 interposed between a first 4 and second plate of a clip 2, such that a fastener 26 will pass through and/or into (a) a fastening point 8 in the first plate 4 of the clip 2, (b) the fabric 30, and (c) a fastening point 10 of the second plate 6 of the clip 2.

The term "inserting a plurality of fasteners through a plurality of fastening points to connect the first plate, the fabric, and the second plate of a clip" should be should be broadly understood and include and/or refer to any situations, steps, and/or other circumstances resulting in connection of a first and second plate of a clip, with fabric interposed between such first and second plate, via a fastener. Furthermore, such term broadly understood and include and refer to, e.g., situations where a party assembling a system of this invention has performed all of the steps that result in connection of a first and second plate of a clip, with fabric interposed between such first and second plate, via a fastener, as well as to situations where a third party has performed one or more of the steps that result in connection of a first and second plate of a clip, with fabric interposed between such first and second plate, via a fastener.

As noted above, clips of this invention may aid in achieving several objects of this invention, including the objective of creating a weather protection system that is relatively easy to customize for a particular site. In part, this objective is achieved via the clips of this invention because the clips do not require grommets and/or other pre-formed features of fabric to facilitate connection to the fabric. Accordingly, clips can be placed on fabric, and the placement of clips on fabric can be altered on-site, e.g., at or near the structure. Thus, an advantage of a system of this invention is that clip placement can be made and/or adjusted based on the particular features of the structural element to be protected. Nevertheless, "placing a portion of the fabric between a first and second plate of a clip" and "inserting a plurality of fasteners through a plurality of fastening points to connect the first plate, the fabric, and the second plate of a clip" may take place off-site, e.g., at a factory, manufacturing facility, or other location separate from the structure. For example, a party assembling a system of this invention may perform the steps "placing a portion of the fabric between a first and second plate of a clip" and "inserting a plurality of fasteners through a plurality of fastening points to connect the first plate, the fabric, and the second plate of a clip" by receiving fabric with one or more clips placed around some portion or all of the perimeter of the fabric. Such party may (but need not) move one or more clips so placed on the fabric when assembling a system of this invention.

Figure 10:
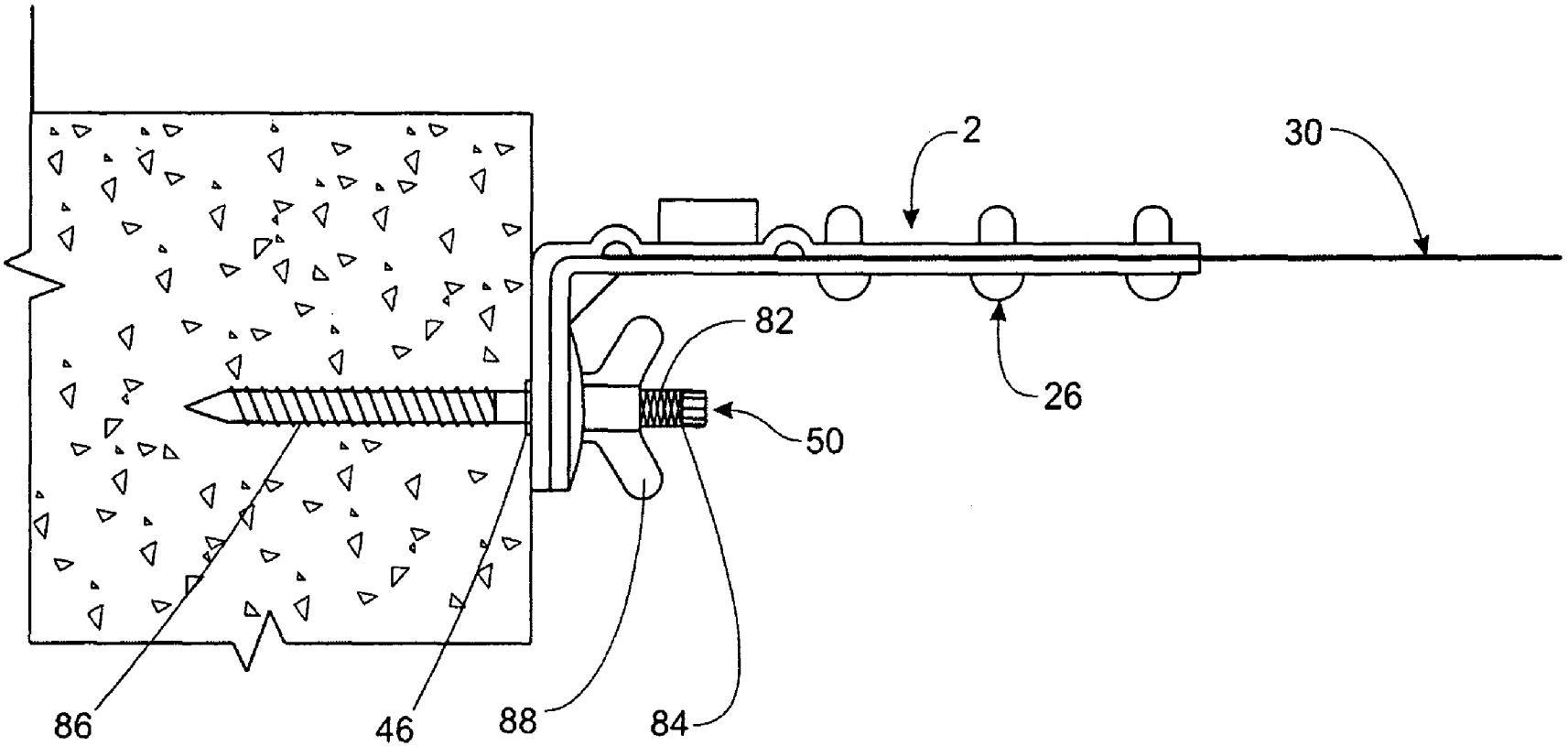
FIG. 10 is a side view of an installed weather protection system, according to an embodiment of the invention.

The preferred spacing of a plurality of clips along all or a portion of the perimeter of the fabric may vary depending upon factors such as: (1) the severity of weather events in the geographic location of the structure, (2) the size of the structural element for which a system is assembled, (3) the length of the secured span, (4) the intended anchoring device, and/or (5) the structural material (e.g., concrete, filled concrete masonry unit ("cmu"), hollow cmu, or timber). The following chart provides preferred spacing of clips of a system of this invention wherein the anchoring device is of a type similar to the anchoring device illustrated on FIG. 10.

FASTENER SPACING OF A SINGLE UNIT SCREEN FOR ANY LENGTH ATTACHED WITH ½" ELCO PANELMATE INSERT (INCHES)

| SCREEN | CONC. & FILLED CMU PRESSURE (PSF) | | | HOLLOW CMU PRESSURE (PSF) | | | TIMBER PRESSURE (PSF) | | |
|---|---|---|---|---|---|---|---|---|---|
| SPAN | 60 | 50 | 40 | 60 | 50 | 40 | 60 | 50 | 40 |
| 5'-0" | 12 | 12 | 12 | 12 | 12 | 12 | 8 | 9 | 10 |
| 6'-0" | 12 | 12 | 12 | 12 | 12 | 12 | 7 | 8 | 9 |
| 7'-0" | 12 | 12 | 12 | 12 | 12 | 12 | 6 | 7 | 8 |
| 8'-0" | 12 | 12 | 12 | 11 | 12 | 12 | 5 | 6 | 7 |
| 9'-0" | 11 | 12 | 12 | 10 | 12 | 12 | 5 | 6 | 7 |
| 10'-0" | 11 | 12 | 12 | 9 | 11 | 12 | 5 | 5 | 6 |
| 11'-0" | 10 | 11 | 12 | 9 | 10 | 12 | 4 | 5 | 6 |
| 12'-0" | 9 | 11 | 12 | 8 | 9 | 11 | 4 | 5 | 5 |
| 12'-6" | 9 | 10 | 12 | 8 | 9 | 11 | 4 | 4 | 5 |

Figure 11:
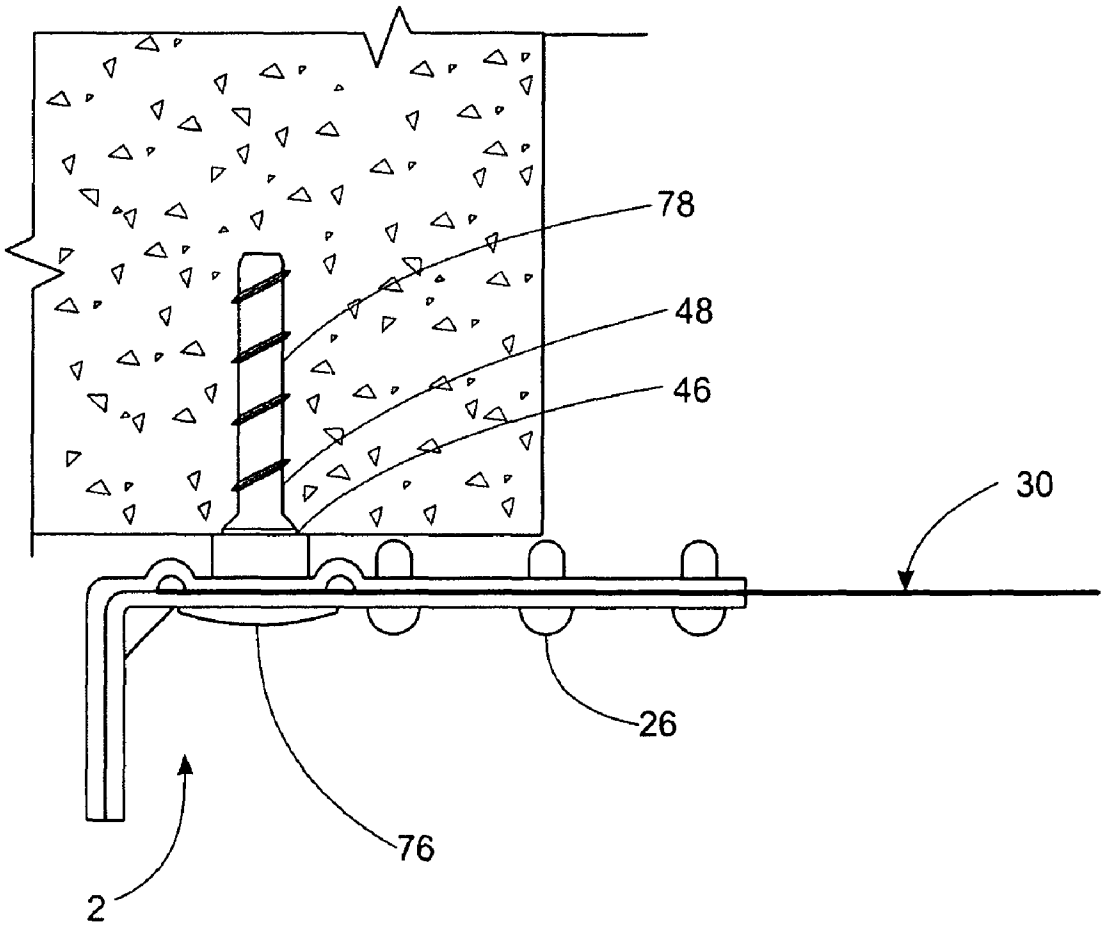
FIG. 11 is a side view of an installed weather protection system, according to an embodiment of the invention.
Figure 12:
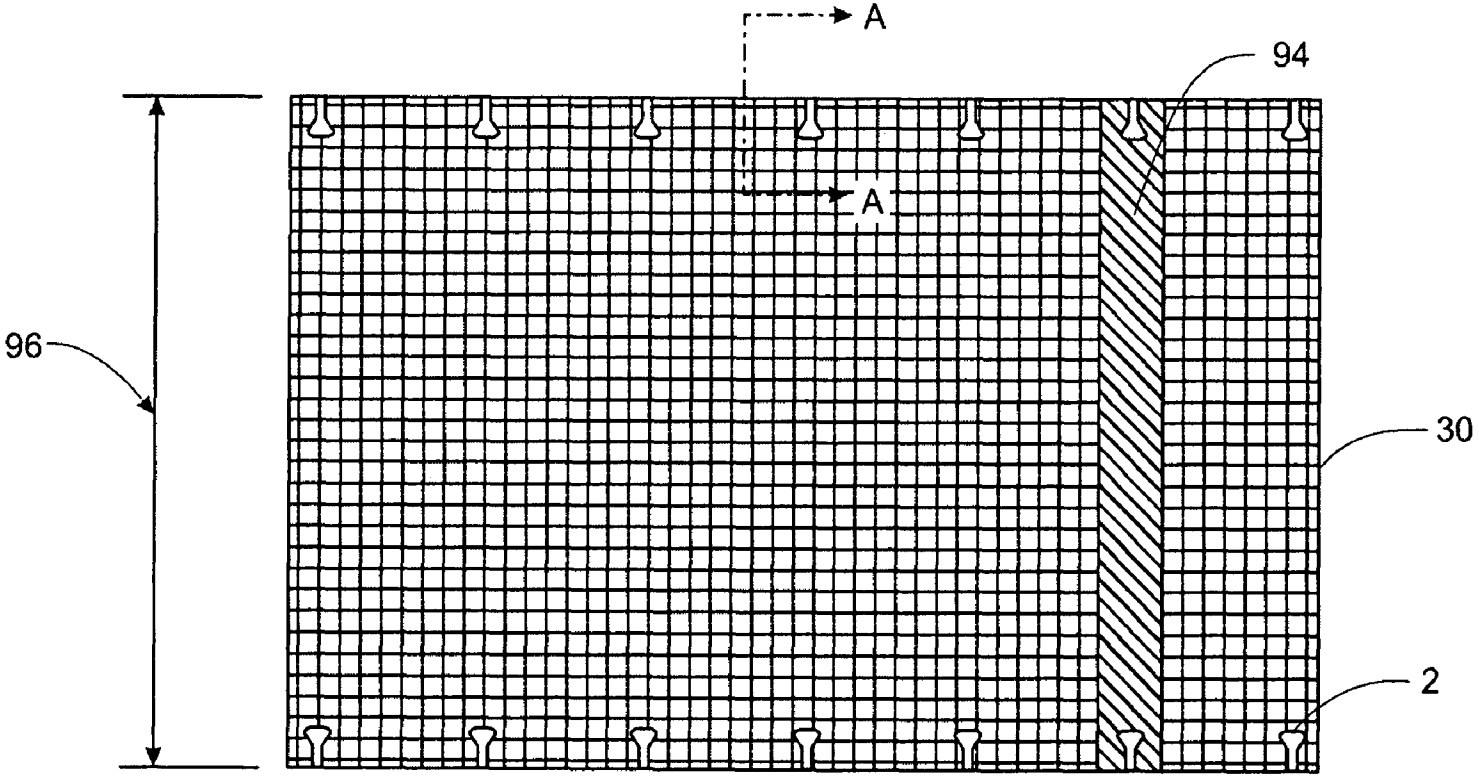
FIG. 12 is a front view of a weather protection system, according to an embodiment of the invention.

The following chart provides preferred spacing of clips of a system of this invention wherein the anchoring device is of a type similar to the anchoring device illustrated on FIG. 11.

FASTENER SPACING OF A SINGLE UNIT SCREEN FOR ANY LENGTH ATTACHED WITH ¼" ELCO PANELMATE PRO, MALE & FEMALE (INCHES)

| SCREEN | CONC. & FILLED CMU PRESSURE (PSF) | | | HOLLOW CMU PRESSURE (PSF) | | | TIMBER PRESSURE (PSF) | | |
|---|---|---|---|---|---|---|---|---|---|
| SPAN | 60 | 50 | 40 | 60 | 50 | 40 | 60 | 50 | 40 |
| 5'-0" | 12 | 12 | 12 | 6 | 8 | 9 | 8 | 9 | 10 |
| 6'-0" | 12 | 12 | 12 | 6 | 6 | 8 | 7 | 8 | 9 |
| 7'-0" | 12 | 12 | 12 | 5 | 6 | 7 | 6 | 7 | 8 |
| 8'-0" | 12 | 12 | 12 | 4 | 5 | 6 | 5 | 6 | 7 |
| 9'-0" | 11 | 12 | 12 | 4 | 5 | 6 | 5 | 6 | 7 |
| 10'-0" | 10 | 11 | 12 | 4 | 4 | 5 | 5 | 5 | 6 |
| 11'-0" | 9 | 11 | 12 | 3 | 4 | 5 | 4 | 5 | 6 |
| 12'-0" | 9 | 10 | 12 | 3 | 4 | 4 | 4 | 5 | 5 |
| 12'-6" | 8 | 10 | 11 | 3 | 3 | 4 | 4 | 4 | 5 |

Assembling a system of this invention may further comprise one or more of the steps of: (1) providing resin; (2)

applying resin to a clip; and/or (3) providing a plurality of straps sized to fit the secured span.

The term "providing resin" and the like should be broadly understood and include and/or refer to situations where a party assembling a system of this invention has e.g., received; obtained, or is otherwise providing resin and/or in which a third party has received, obtained, or otherwise provided the resin (which resin may have been and/or may be mixed and/or otherwise prepared for application by such party and/or a third party).

The term "applying resin to a clip" and the like should be broadly understood and include and/or refer to any situations, steps, and/or other circumstances resulting in application of resin to a clip. If a clip of the invention comprises one or more resin receptacles and if a method of assembling a system of this invention comprises applying resin to a clip, such step preferably comprises applying resin to a clip at or near a resin receptacle. For example, in a preferred method of applying resin to a clip, resin is brushed onto the clip at one or more resin receptacles; in such embodiment, resin is preferably applied to a clip after a plurality of fasteners has been inserted through a plurality of fastening points to connect the first plate, the fabric, and the second plate of a clip. In another embodiment of a method of this invention, resin could be applied to a fastener before it is inserted through a plurality of fastening points to connect the first plate, the fabric, and the second plate of a clip, in which case the step of "applying resin to a clip" may occur essentially simultaneously with the step of inserting a fastener through a plurality of fastening points to connect the first plate, the fabric, and the second plate of a clip. In an embodiment in which resin is provided in a pre-dried form, e.g., as a patty, application of resin to a clip may comprise placing pre-dried resin between fabric and a first or second plate of the clip; preferably the pre-dried resin would be placed at a fastening point and/or a resin receptacle. Preferably, resin is applied after any adjustments to clip placement have been made (which may be after a system is installed or partially installed according to a method of this invention).

The term "applying resin to a clip" should be further understood and include and refer to, e.g., situations where a party assembling a system of this invention has performed all of the steps that result in application of resin to clip as well as to situations where a third party has performed one or more of the steps that result in application of resin to a clip.

The term "providing a plurality of straps sized to fit the secured span" and the like should be broadly understood and include and/or refer to situations where a party assembling a system of this invention has e.g., received, obtained, or is otherwise providing a plurality of straps sized to fit the secured span and/or in which a third party has received, obtained, or otherwise provided to the party assembling a system of this invention a plurality of straps sized to fit the secured span (which straps may have been and/or may be sized to fit the secured span by such party and/or a third party).

This invention further provides methods of installing a weather protection system. As discussed herein, weather protection systems of this invention can be used to mitigate damage to a structure resulting from severe weather events by protecting one or more structural elements of such structure. Thus, reference to installation of a weather protection system "over a structural element" should be broadly understood to refer to installation of a weather protection system according to a method of this invention such that the weather protection system, when installed, covers all or a substantial portion of the vulnerable element of such structural portion.

A preferred method of installing a weather protection system of this invention at a structural element comprises the following steps: (1) providing an assembled weather protection system, such assembled weather protection system comprising (a) fabric sized to substantially cover the structural element; and (b) a plurality of clips connected to such fabric using a plurality of fasteners; (2) providing a plurality of anchoring devices; (3) designating a plurality of securing points around the structural element; and (4) connecting the assembled weather protection system to the structure.

The term "providing an assembled weather protection system" and the like should be broadly understood and include and/or refer to situations where a party installing a system of this invention has e.g., received, obtained, assembled, or is otherwise providing an assembled weather protection system and/or in which a third party has received, obtained, or otherwise provided to the party installing a system of this invention an assembled weather protection systems (which fabric may have been assembled in whole or in part by such third party, another third party and/or the party installing the weather protection system).

The term "providing a plurality of anchoring devices" and the like should be broadly understood and include and/or refer to situations where a party installing a system of this invention has e.g., received, obtained, or is otherwise providing anchoring devices and/or in which a third party has received, obtained, or otherwise provided to the party installing a system of this invention a plurality of anchoring devices. After a system of this invention has been installed (or partially installed) a first time, anchoring devices may be left in the securing points; in such case, the step of "providing a plurality of anchoring devices" could comprise removing or otherwise obtaining the anchoring devices from the securing points.

As noted above, a preferred securing point 46 for a system of this invention is: (1) at or in a structural component of the structure, and (2) outside of, but relatively close to, the vulnerable portion of the structural element. Other desirable characteristics of a securing point may be determined, at least in part, by the intended anchoring device, as will be understood by those with skill in the art. The term "designating a plurality of securing points around the structural element" and the like should be broadly understood and include and/or refer to situations where a party installing a system of this invention has e.g., identified, located, approved, or otherwise designated securing points based on the party's own observations and/or the observations, directions, and/or instructions of one or more third parties.

In some embodiments of a method of this invention, e.g., after a system of this invention has been installed (or partially installed) for the first time, "designating a plurality of securing points around the structural element" may simply refer to locating the previously identified securing points, if and to the extent the initially identified securing points remain acceptable for use as securing points of a system of this invention.

As will be understood by those with skill in the art, preferred spacing for a plurality of securing points to be used to connect a weather protection system to a structure to cover a structural element will correspond with preferred spacing for the plurality of clips for such weather protection system. The plurality of securing points should comprise securing points on opposing sides of the structural element. Securing points 46 may be also be located on adjacent sides, e.g., with a 4-sided structure, securing points must be located on at least two opposing sides (a top and bottom, a right side and a left side, and the like) and securing points may be located on the third and/or fourth sides. Preferably, the secured span 96 does not exceed 149 inches in length; however, for a particular structural element, it may be acceptable to have a secured span in first direction that exceeds 149 inches in length so long as there is a secured span in a second direction that is 149 inches or less. It will be understood that in the context of a structural element that is, for example, a circle or an oval, a "side" of the structural element may simply refer to a portion of such structural element and "opposing sides" may simply refer to opposing portions of such structural element.

The term "connecting the assembled weather protection system to the structure" and the like should be broadly understood and include and/or refer to any situations, steps, and/or other circumstances resulting in connection of the assembled weather protection system to the structure at securing points 46 of the structure and at anchor points 12, 14, 16, 17 of the clips, using the provided anchoring devices 80, 82. Preferably, the step "connecting the assembled weather protection system to the structure" further comprises the following steps: (i) inserting an anchoring device into a securing point, (ii) placing the anchoring device through or into an anchor point of a clip, and (iii) securing the anchoring device to connect the clip to the structure at the securing point.

Methods of inserting, affixing, attaching, and/or otherwise connecting an anchoring device 80, 82 to the structure at a securing point 46 are well known and need not be described herein in detail. It is further known that preferred methods of connection will vary depending upon the material comprising the securing point (e.g., concrete, filled cmu, hollow cum, timber). The following chart illustrates preferred minimum edge distances and minimum embedments for certain embodiments of anchoring devices and securing points used in connection with a system of this invention:

| | CONC. & FILLED CMU (3500 PSI) | | HOLLOW CMU (1800 PSI) | | WOOD (S.G. = .64) | |
|---|---|---|---|---|---|---|
| ANCHOR | MIN. EDGE | MIN EMB. | MIN. EDGE | MIN EMB. | MIN. EDGE | MIN EMB. |
| ½" PANELMATE INSERT | 3½" | 1¾" | 3½" | 1¼" | 2" | 2" |
| ¼" PANELMATE PRO, MALE & FEMALE | 2½" | 2" | 2½" | 1¼" | 2" | 2" |

Thus, the term "inserting an anchoring device into a securing point" should be broadly understood and include and refer to, e.g., situations where a party installing a system of this invention has performed all of the steps that result in inserting, affixing, attaching, and/or otherwise connecting an anchoring device 80, 82 to the structure at a securing point 46 as well as to situations where a third party has performed one or more of the steps that result in inserting, affixing, attaching, and/or otherwise connecting an anchoring device to the structure at a securing point. Typically, after an anchoring device has been inserted into a securing point, e.g., at a first installation (or partial installation) of a system of this invention, the anchoring device will not be removed. Accordingly, a party installing a weather protection system of this invention may be deemed to have performed the step of "inserting an anchoring device into a securing point" if such step has been previously accomplished, by such party and/or a third party, in connection with this instance of installation or a prior instance of installation.

"Placing the anchoring device through or into an anchor point of a clip" will be readily understood and refers to the step or steps required to insert or otherwise connect a portion of the anchoring device 80, 82 through or otherwise into an anchor point 12, 14, 16, 17 of a clip 2, e.g., inserting the male portion of an anchoring device through an anchor point. Thus, the term "placing the anchoring device through or into an anchor point of a clip," and the like should be broadly understood and include and/or refer to situations where a party installing a system of this invention has e.g., inserted or otherwise connected an anchoring device through or into an anchor point of a clip and/or to situations in which a third party has inserted or otherwise connected an anchoring device through or into an anchor point of a clip composing a system being installed by such party according to a method of this invention.

Again, the step "securing the anchoring device to connect the clip to the structure at the securing point" will be readily understood and refers to the step or steps required to secure the anchoring device to connect the clip to the structure at the securing point. Thus, this step may comprise tightening a nut composing an anchoring device or tightening a bolt composing an anchoring device. It will be further understood that the steps "placing the anchoring device through or into an anchor point of a clip" and "securing the anchoring device to connect the clip to the structure at the securing point" may be largely contemporaneous, depending upon the type of anchoring device. Thus, the term "securing the anchoring device to connect the clip to the structure at the securing point", and the like should be broadly understood and include and/or refer to situations where a party installing a system of this invention has e.g., inserted or otherwise connected an anchoring device through or into an anchor point of a clip and/or to situations in which a third party has inserted or otherwise connected an anchoring device through or into an anchor point of a clip composing a system of this invention being installed by such party according to a method of this invention.

Each of the steps of a method of this invention of assembling a weather protection systems may compose a method of this invention of installing a weather protection system. For example, a method of installing a weather protection system of this invention may comprise the step "providing a plurality of straps sized to fit the secured span." In such an embodiment, a method of installing a weather protection system according to this invention preferably further comprises the step "connecting the plurality of straps to the structure at securing points across a secured span."

The step "connecting the plurality of straps to the structure at securing points across a secured span" will be readily understood and refers to the step or steps required to secure the anchoring device to connect a strap to the structure at a securing point. Typically, this step comprises inserting a first anchoring device through a strap connection point at a first end of the strap and inserting a second anchoring device through a strap connection point at a second end of the strap. Preferably, the first and second anchoring devices are on opposing sides of a secured span 96 of a structural element.

Although embodiments of a system of this invention comprising a strap in which the anchoring device and securing point used for a strap are also used for a clip are preferred, in other embodiments, a separate securing point and anchoring device may be provided to connect a strap to a structure, in connection with installation of a system of this invention. The preferred orientation of a strap is behind strap is behind the fabric, i.e., between the fabric and the structural element. Straps can be provided at some or all of the sets of clips on opposing sides of a secured span.

The term "connecting the plurality of straps to the structure at securing points across a secured span", and the like should be broadly understood and include and/or refer to situations where a party installing a weather protection system according to a method of this invention has performed some portion or all of the steps to connect the plurality of straps to the structure at securing points across a secured span and/or to situations in which a third party has performed some portion or all of the steps to connect the plurality of straps to the structure at securing points across a secured span.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. For example, to one of ordinary skill in the art, it will be readily apparent that the system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

We claim:

1. A weather protection system for a structural element, said weather protection system comprising:

(a) a coated high tenacity nylon fabric sized to fit said structural element;

(b) a plurality of anchoring devices;

(c) a plurality of fasteners; and (d) a plurality of clips, wherein each clip comprises a first plate, a second plate, a first anchor opening, a second anchor opening, and a plurality of fastening points, wherein said first plate is adapted to be connected to said second plate at said fastening points with said fasteners, and wherein said first anchor opening and said plurality of fastening points lie in a first plane and said second anchor opening lies in a second plane that is substantially perpendicular to said first plane.

2. The system of claim 1, further comprising a ceramic resin.

3. The system of claim 1, further comprising a plurality of straps sized to fit a secured span of said structural element wherein said straps are adapted to be placed between said fabric and said structural element.

4. The system of claim 1, wherein said clips further comprise super tough nylon.

5. The system of claim 1, wherein said fasteners comprise mechanical fasteners.

6. The system of claim 5, wherein said fasteners comprise screws.

7. The system of claim 1, wherein each of said clips further comprises an engaging member.

8. The system of claim 1, wherein said second anchor opening of the first plate comprises an annular protrusion and the second anchor opening of the second plate comprises a hole adapted to mate with the annular protrusion of the second anchor opening of the first plate.

9. The system of claim 1, wherein said first anchor opening is a stabilizing anchor point.

10. A weather protection system for a structural element, said weather protection system comprising:

(a) a coated high tenacity nylon fabric sized to fit said structural element;

(b) a plurality of anchoring devices;

(c) a plurality of mechanical fasteners;

(d) a plurality of clips, wherein each clip comprises a first plate, a second plate, a first anchor opening, a second anchor opening, an engaging member, and a plurality of fastening points, wherein said first plate is adapted to be connected to said second plate at said fastening points with said mechanical fasteners, and wherein said first anchor opening and said plurality of fastening points lie in a first plane and said second anchor opening lies in a second plane that is substantially perpendicular to said first plane; and (e) a plurality of straps sized to fit a secured span of said structural element wherein said straps are adapted to be placed between said fabric and said structural element.

11. A method of assembling a weather protection system, the method comprising the steps:

(a) identifying a structural element;

(b) providing a coated high tenacity nylon fabric sized to substantially cover the structural element;

(c) providing a plurality of clips, said clips comprising a first plate, a second plate, a first anchor opening, a second anchor opening, and a plurality of fastening points, wherein said first plate is adapted to be connected to said second plate at said fastening points with said fasteners, and wherein said first anchor opening and said plurality of fastening points lie in a first plane and said second anchor opening lies in a second plane that is substantially perpendicular to said first plane;

(d) providing a plurality of fasteners; and (e) connecting said clips to the fabric using said fasteners.

12. The method of claim 11, further comprising the steps:

(a) providing a resin; and (b) applying said resin to said clip.

13. A method of installing a weather protection system on a structure, the method comprising the steps:

(a) identifying a structural element;

(b) providing a coated high tenacity nylon fabric sized to substantially cover the structural element;

(c) providing a plurality of clips, said clips comprising a first plate, a second plate, a first anchor opening, a second anchor opening, and a plurality of fastening points, wherein said first plate is adapted to be connected to said second plate at said fastening points with said fasteners, and wherein said first anchor opening and said plurality of fastening points lie in a first plane and said second anchor opening lies in a second plane that is substantially perpendicular to said first plane;

(d) providing a plurality of fasteners;

(e) connecting said clips to the fabric using said fasteners to create an assembled weather protection system;

(f) designating a plurality of securing points around said structural element; and (g) connecting said assembled weather protection system to said structure.

14. The method of claim 13, wherein said clips provided in step (c) further comprise super tough nylon.

15. The method of claim 13, further comprising the steps:

(a) providing a resin; and (b) applying said resin to said clips.

16. The method of claim 15, wherein said structural element comprises a secured span, said method further comprising the steps:

(a) providing a plurality of straps sized to fit said secured span; and (b) connecting said plurality of straps to said structure.

17. A method of installing a weather protection system on a structure, the method comprising the steps:

(a) providing an assembled weather protection system for a structural element, said weather protection system comprising (i) a coated high tenacity nylon fabric sized to substantially cover said structural element, (ii) a plurality of fasteners, and (iii) a plurality of clips connected to said fabric using said fasteners, said clips comprising a first plate, a second plate, a first anchor opening, a second anchor opening, and a plurality of fastening points, wherein said first plate is adapted to be connected to said second plate at said fastening points with said fasteners, and wherein said first anchor opening and said plurality of fastening points lie in a first plane and said second anchor opening lies in a second plane that is substantially perpendicular to said first plane;

(b) designating a plurality of securing points around said structural element;

(c) providing a plurality of straps sized to fit said secured span;

(d) placing said plurality of straps between said fabric and said structure; and (e) connecting said assembled weather protection system to said structure.

* * * * *